US006884388B2

(12) United States Patent
Ozaki et al.

(10) Patent No.: US 6,884,388 B2
(45) Date of Patent: Apr. 26, 2005

(54) LOW CARBON MARTENSITIC STAINLESS STEEL AND METHOD FOR PRODUCTION THEREOF

(75) Inventors: Yoshihiro Ozaki, Chiba (JP); Toshimitsu Nagaya, Chiba (JP); Atsushi Miyazaki, Chiba (JP); Susumu Satoh, Chiba (JP); Mineo Muraki, Kurashiki (JP); Setsuo Kakihara, Chiba (JP); Toshihiro Kasamo, Chiba (JP)

(73) Assignee: JFE Steel Corporation, Tokyo (JP)

( * ) Notice: Subject to any disclaimer, the term of this patent is extended or adjusted under 35 U.S.C. 154(b) by 143 days.

(21) Appl. No.: 10/344,535

(22) PCT Filed: Aug. 31, 2001

(86) PCT No.: PCT/JP01/07564

§ 371 (c)(1),
(2), (4) Date: Feb. 12, 2003

(87) PCT Pub. No.: WO02/18666

PCT Pub. Date: Mar. 7, 2002

(65) Prior Publication Data

US 2004/0096352 A1 May 20, 2004

(30) Foreign Application Priority Data

Aug. 31, 2000 (JP) ..... 2000-263594
Aug. 31, 2000 (JP) ..... 2000-263595

(51) Int. Cl.[7] ..... C22C 38/24; C22C 38/26; C22C 38/28; C21D 8/02

(52) U.S. Cl. ..... 420/70; 148/325; 148/661; 148/653; 148/608

(58) Field of Search ..... 420/68–70; 148/653, 148/325, 608, 661

(56) References Cited

FOREIGN PATENT DOCUMENTS

| | | |
|---|---|---|
| EP | 1106705 | 6/2001 |
| JP | 6-306482 | 11/1994 |
| JP | 2000-26941 | 1/2000 |
| JP | 2000-109956 | 4/2000 |
| JP | 2001-192779 | 7/2001 |
| JP | 2001-3141 | 9/2001 |

*Primary Examiner*—Deborah Yee
(74) *Attorney, Agent, or Firm*—Young & Thompson

(57) ABSTRACT

A martensitic stainless steel sheet which is hard to be softened by tempering caused by heating during the use of a disk brake, can maintain the predetermined hardness, and has excellent punching workability, bending workability before quenching, and a particularly small shear drop, and in which a predetermined hardness after quenching is constantly achieved, in a low carbon martensitic stainless steel sheet used only after quenching. Specifically, the sheet contains, on the basis of mass percent, 0.030% to 0.100% C; 0.50% or less of Si; 1.00% to 2.50% Mn; more than 10.00% to 15.00% Cr; at least one selected from the group consisting of 0.01% to 0.50% Ti, 0.01% to 0.50% V, 0.01% to 1.00% Nb, and 0.01% to 1.00% Zr; N in an amount defined by the following expression, N: 0.005% to (Ti+V)×14/50+(Nb+Zr)×14/90; and the balance being Fe and incidental impurities.

18 Claims, 6 Drawing Sheets

LOW CARBON MARTENSITIC STAINLESS STEEL AND METHOD FOR PRODUCTION THEREOF

TECHNICAL FIELD

The present invention relates to martensitic stainless steel which is used only after quenching, is suitable for car members or mechanical members such as disk brakes for two wheelers such as motorcycles. The present invention also proposes martensitic stainless steel which has a required hardness after quenching and excellent workability (punching workability, bending workability, and so on) before quenching. In the present invention, % indicating a content represents mass percent as long as it is not particularly specified.

BACKGROUND ART

It is necessary for a disk brake material for two wheelers to have wear resistance in order to maintain the performance of brakes over the long term. In general, when the hardness increases, the wear resistance is improved and the toughness is degraded on the other hand. In view of the above, car or mechanical members which needs wear resistance and toughness are controlled to have a Vickers hardness, namely, Hv, of 310 to 380, and a Rockwell scale C hardness, namely, HRC, of 30 to 40 in many cases.

Hitherto, for the above use, high carbon martensitic stainless steel such as SUS420J1 containing 0.2% C and SUS420J2 containing 0.3% C or low carbon martensitic stainless steel have been used.

In general, hot-rolled steel sheets are used after annealing and may be shot blasted or washed with acid according to needs. Members such as disk brakes are manufactured as follows: the above hot-rolled steel sheet is punched, is formed into a predetermined shape, is quenched, and then is tempered to adjust the hardness according to needs. Since the above method needs two heating steps, that is, quenching and tempering, the production cost is high. Since changes in the hardness of the high carbon martensitic stainless steel such as SUS420J1 or SUS420J2 are large when quenching temperature changes, extremely precise control is required in a heat-treating step to achieve a predetermined hardness only by quenching. There is also a problem in that a low Cr content region forms around chromium carbonitride precipitates in tempering so that the corrosion resistance decreases, even if the control of annealing conditions is relieved by performing tempering.

On the other hand, as disclosed in Japanese Unexamined Patent Application No. 57-198249 and Japanese Unexamined Patent Application No. 60-106951, low carbon martensitic stainless steel which has a appropriate hardness only by quenching, that is, without tempering, has been recently used. Two wheeler disk brakes made of the above low carbon martensitic stainless steel are used for motorcycles for sports and middle-sized or large-sized motorcycles which are relatively expensive. Since the motorcycles are apt to be large-sized and have high performance so that circumstances in which the brakes are used are becoming severe, the brakes need higher performance.

The function of disk brakes is to decelerate by converting the kinetic energy of vehicles into heat with sliding friction. Thus, in large-sized and high-speed motorcycles, a larger amount of heat arises at disk brakes, so that the temperature increases up to 500° C. to 600° C. in some cases.

There is a problem in that the hardness of conventional low carbon martensitic stainless steel is decreased by tempering according to the condition, that is, the steel is softened. Once the disk brake has been softened by tempering, the wear resistance is degraded and the predetermined performance can not maintained. In order to prevent the softening, the following methods to prevent disks from being excessively heated have been proposed: increasing the heat capacity by enlarging the thickness of a disk, changing the design for heat dissipation, increasing the number of a disk (changing a single disk to a double disk), and so on. However, any of the methods is not the industrially effective solution of the above problems because the methods cause increase in the cost due to increase in the weight and due to the complexity in processing. In the low carbon martensitic stainless steel disclosed in Japanese Unexamined Patent Application No. 57-198249, since changes in the hardness according to the annealing temperature are reduced, it is not necessary to severely control the conditions of heat treating of the high carbon martensitic stainless steel.

In conventional low carbon martensitic stainless steel, since the hardness by quenching is slightly in proportion to the quenching temperature, the control of heat treating is easy, and which is advantageous. However, there is a problem in that sag arises in machining and forming processes before quenching, particularly in a blanking process.

When disk brakes are made of these materials, there is a problem in that machining accuracy is decreased due to "shear drop (may be called sag or cambering)" (shown in FIG. 4) which is formed in such a manner that the vicinity of a sheared region with a punching die is drawn into a plastic deformation region in blanking before quenching. Once the shear drop has been formed at the marginal part of the punched portion, it is necessary to additionally perform cutting and grinding to smooth the surface in the subsequent processes until the sag disappears, in order to maintain a appropriate shape and prevent chattering caused by friction with other members; thereby causing increase in man hour and decrease in yield.

In order to solve the above problem, the following methods have been studied: increasing the content of alloy elements such as Cu to promote solid solution and precipitation, and applying machining effects by rolling under light load. However, in the former method, there is a problem in that the control of the hardness is difficult due to increase in the quenching sensitivity caused by added components and the alloy cost increases. In the latter method, there is a problem in that surface defects arise and the cost increases due to the addition of a hot-rolling step.

Other characteristics required to manufacture the above members are the formability (the bending formability) before quenching, the machinability (the drilling performance), and the oxidation resistance in heating for quenching. In steel having conventional composition, any of these characteristics is limited and improvements still remain.

Accordingly, it is the first object of the present invention to provide martensitic stainless steel which is hard to be softened by tempering caused by heating during the use of a disk brake and maintain the predetermined hardness, in low carbon martensitic stainless steel used only after quenching.

It is the second object of the present invention to provide martensitic stainless steel which has excellent punching workability, bending workability before quenching, and a particularly small shear drop and in which a predetermined hardness after quenching is constantly achieved. Furthermore, it is the third object of the present invention to provide martensitic stainless steel in which the machinability and the oxidation resistance are improved.

DISCLOSURE OF INVENTION

As a result of intensive research on the composition to solve the above problems, the inventors have found that, in low carbon martensitic stainless steel having predetermined composition, controlling the content of Ti, V, Nb, Zr, and N in an appropriate range increases softening resistance in tempering and provides desired effects. The present invention is completed according to the above findings.

The present invention provides a low carbon martensitic stainless steel sheet having high heat resistance, containing, on the basis of mass percent, 0.030% to 0.100% C; 0.50% or less of Si; 1.00% to 2.50% Mn; more than 10.00% to 15.00% Cr; at least one selected from the group consisting of 0.01% to 0.50% Ti, 0.01% to 0.50% V, 0.01% to 1.00% Nb, and 0.01% to 1.00% Zr; N in an amount defined by the following expression, N: 0.005% to (Ti+V)×14/50+(Nb+Zr)×14/90; and the balance being Fe and incidental impurities.

The present invention provides a martensitic stainless steel sheet having high heat resistance and excellent workability, further containing, on the basis of mass percent, more than 0.040% to 0.100% C+N and 0.02% to 0.50% in total of at least one selected from the group consisting of 0.01% to 0.50% V, 0.01% to 0.50% Nb, 0.01% to 0.50% Ti, 0.01% to 0.50% Zr, 0.50% or less of Ta, and 0.50% or less of Hf.

The present invention provides a low carbon martensitic stainless steel sheet having high heat resistance and excellent workability, further comprising, on the basis of mass percent, at least one selected from the group consisting of 0.01% to 1.00% Ni, preferably 0.60% or less of Ni, and 0.01% to 0.50% Cu.

The present invention provides a low carbon martensitic stainless steel sheet having high heat resistance and excellent workability, further containing, on the basis of mass percent, at least one selected from the group consisting of 0.050% to 1.000% Mo and 0.0002% to 0.0010% B.

The present invention provides a low carbon martensitic stainless steel sheet having high heat resistance and excellent workability, further containing, on the basis of mass percent, 0.01% to 1.00% Nb, 0.050% to 1.000% Mo, and 0.0002% to 0.0010% B.

The present invention provides a low carbon martensitic stainless steel sheet having high heat resistance and excellent workability, further containing, on the basis of mass percent, at least one selected from the group consisting of 0.01% to 0.50% Co and 0.01% to 0.50% W.

The present invention provides a low carbon martensitic stainless steel sheet having high heat resistance and excellent workability, further containing, on the basis of mass percent, at least one selected from the group consisting of 0.0002% to 0.0050% Ca and 0.0002% to 0.0050% Mg.

The present invention provides a low carbon martensitic stainless steel sheet having high heat resistance and excellent workability, further containing 0.100% by mass or less of Al.

The present invention provides a method for manufacturing the above low carbon martensitic stainless steel sheet having high heat resistance and excellent workability, wherein the annealing temperature in an annealing step after hot-rolling is 550° C. to 750° C.

The present invention provides a method for manufacturing the above low carbon martensitic stainless steel sheet having high heat resistance and excellent workability, wherein the heating rate in the annealing step is 20° C./min to 50° C./min. and the cooling rate from the annealing temperature to 500° C. is in the range of 5° C./min. to 30° C./min.

The present invention provides a method for manufacturing the above low carbon martensitic stainless steel sheet having high heat resistance and excellent workability, wherein the annealing time in the annealing step is 4 hours to 12 hours.

The present invention provides a method for manufacturing the above low carbon martensitic stainless steel sheet having high heat resistance and excellent workability, wherein the sheet after the annealing process and before punching has an HRB hardness of 85 to 100.

BEST MODE FOR CARRYING OUT THE INVENTION

Figure 1:
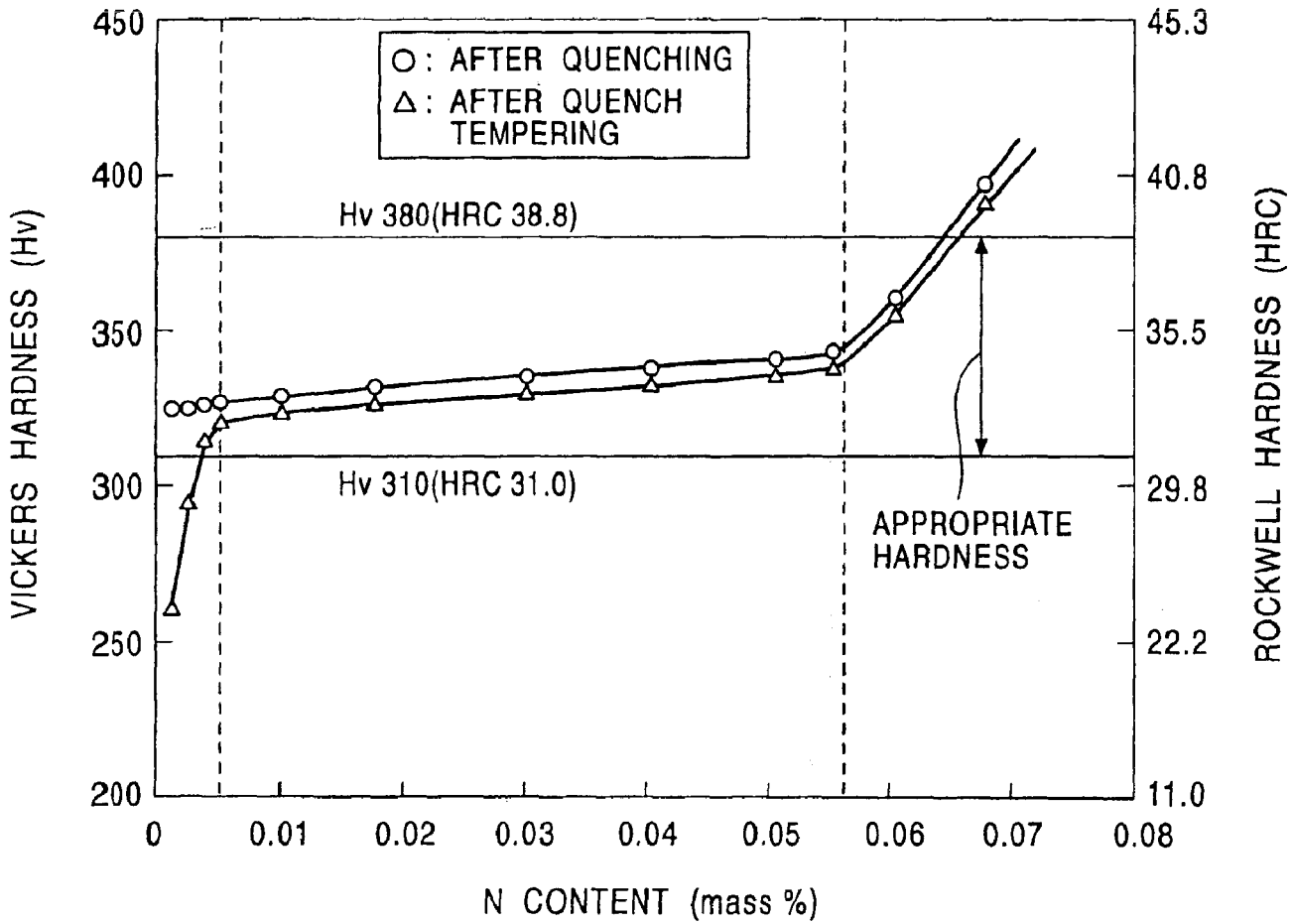
FIG. 1 is a graph showing the relationship between the N content and the hardness after quenching, in a martensitic stainless steel sheet containing Ti and V.

The reason for the composition of martensitic stainless steel according to the present invention being limited to the above conditions will now be described. In this specification, % indicating the content represents mass percent as long as it is not particularly specified. C: 0.030 to 0.100%

Elemental C increases the hardness of martensite after quenching and is effective in the improvement of wear resistance. When the C content is less than 0.030%, the hardness required of disk brakes can not be achieved only by quenching (without tempering). On the other hand, when the C content exceeds 0.100%, the hardness becomes excessive. Thus, it is necessary that the C content ranges from 0.030% to 0.100% in order to achieve the appropriate hardness required of the disk brakes only by quenching.

N: 0.005 to (Ti+V)×14/50+(Nb+Zr)×14/90

In order to maintain the appropriate hardness and to inhibit softening caused by elemental Ti, V, Nb, and Zr, it is necessary that the N content is adjusted in the appropriate range. That is, when the N content is less than 0.005%, softening is not inhibited. On the other hand, when the N content exceeds an equivalent or more of nitrides containing Ti, V, Nb, and Zr, constant hardness can not be achieved because the hardness after quenching depends on the N content. Thus, the upper limit of the N content is (Ti+V)×14/50+(Nb+Zr)×14/90.

C+N: more than 0.040 to 0.100%

Elemental C and N increase the hardness and are effective in the improvement of wear resistance. In the Mn content of the present invention, the (C+N) content is more than 0.040% to 0.100% in order to maintain the hardness after quenching in the range of an Hv hardness of 310 to 380 or an HRC hardness of 30 to 40.

Si: 0.50% or less

Elemental Si forms ferrite at high temperature. When the Si content exceeds 0.50%, the hardness after quenching is decreased and the toughness is also degraded. Thus, the upper limit of the Si content is 0.50%. A small amount of Si is preferable.

Mn: 1.00 to 2.50%

Elemental Mn is effective in the inhibition of the formation of ferrite. When the Mn content is less than 1.00%, ferrite is formed and an Hv hardness of 310 to 380 or an HRC hardness of 30 to 40 after quenching can not be achieved. When the Mn content is too small, the annealing temperature to achieve an Hv hardness of 310 to 380 or an HRC hardness of 30 to 40 after quenching is limited in a extremely narrow range; thereby causing the temperature control to be more difficult. Thus, the lower limit of the Mn content is 1.00%. On the other hand, when the Mn content exceeds 2.50%, the following problems arise: a decrease in the oxidation resistance at high temperature, the formation of a large amount of scale in the manufacturing steps of the steel sheet, and a significant decrease in the dimensional accuracy of the steel sheet due to the formation of a rough surface on the steel sheet. Thus, the upper limit of the Mn content is 2.50%.

Cr: more than 10.00 to 15.00%

It is necessary for the steel sheet to contain more than 10.00% of Cr in order to have corrosion resistance. When the Cr content exceeds 15.00%, ferrite is formed at a quenching temperature of 850° C. to 1050° C. even if the contents of Mn, Ni, and Cu, which inhibit ferrite formation, are increased up to the respective upper limits, and thus, an Hv hardness of 310 to 380 or an HRC hardness of 30 to 40 after quenching can not be constantly achieved. The Cr content is consequently more than 10.00% to 15.00%.

Ni: 0.01 to 1.00%

As with Mn, elemental Ni is effective in the inhibition of the formation of a ferrite phase and provides constant hardness after quenching. The Ni content is preferably 0.01% or more to achieve such an effect, and more preferably 0.60% or less.

Cu: 0.01 to 0.50%

As same as Mn, elemental Cu is effective in the inhibition of the formation of a ferrite phase and provides constant hardness after quenching. The Cu content is preferably 0.01% or more to achieve such an effect. On the other hand, when the Cu content is too high, surface cracks, that is, surface defects, are readily formed in a hot-rolling step, and the yield is decreased due to the surface defects on the final products. Furthermore, Cu is an expensive element. Thus, the upper limit of the Cu content is 0.50%.

Mo: 0.050 to 1.000%

Elemental Mo is effective in increasing in the resistance to temper softening of martensite, that is to say, Mo is effective in increasing in heat resistance. When the Mo content is too high, a ferrite phase is stable; thereby degrading the hardness after quenching. Thus, the upper limit of the Mo content is 1.000%. Furthermore, the Mo content is preferably 0.500% or less in order to decrease differences in hardness among steel sheets after quenching. Also, the Mo content is preferably 0.050% or more in order to improve the above resistance.

B: 0.0002 to 0.0010%

Elemental B is effective in the improvement of hardenability and is effective in the achievement of the constant hardness after quenching. B increases the grain boundary strength by allowing grain boundary segregation to occur and improves the workability of the stainless steel. In order to achieve the above effects, it is necessary that the B content is 0.0002% or more. On the other hand, an excessive B content causes the following negative effects on the hot workability: the formation of B, Fe and Cr compounds (a eutectic) having a low melting point; and the formation of hot cracks in a continuous casting step and a hot-rolling step. Thus, the upper limit of the B content is 0.0010%.

Ti: 0.01 to 0.50%, V: 0.01 to 0.50%, Nb: 0.01 to 1.00%, and Zr: 0.01 to 1.00%

Elemental Ti, V, Nb, and Zr are effective in the inhibition of softening caused by heating after quenching. When the contents of these components are low, the inhibition of softening can not be achieved. On the other hand, when these contents are too high, the inhibition of softening is saturated. Thus, the appropriate contents are as follows: a Ti content of 0.01% to 0.50%, a V content of 0.01% to 0.50%, a Nb content of 0.01% to 1.00%, and a Zr content of 0.01% to 1.00%.

Ti: 0.01 to 0.50%, V: 0.01 to 0.50%, Nb: 0.01 to 0.50%, Zr: 0.01 to 0.50%, Ta: 0.50% or less, Hf: 0.50% or less, and a total amount thereof: 0.02 to 0.50%.

Elemental Ti, V, Nb, Zr, Ta, and Hf are extremely important in the present invention. When the content of each of Ti, V, Nb, Zr, Ta, and Hf is 0.50% or less and the total amount thereof is 0.02% to 0.50%, the crystal grain of the steel sheet is refined, and grain growth after the recrystallization is inhibited.

When the steel sheet contains at least one of the above elements, the following effects are achieved: the refining of the crystal grain, the improvement of shear drop caused by punching before quenching, and the maintenance of the toughness after quenching. The mechanisms of the above effects are not necessarily clear and are presumed to be as follows.

(1) Since dislocation in the crystal grain readily concentrates at the grain boundary, the steel sheet has high resistance to plastic deformation. Accordingly, the plastic deformation region arising in a punching process is limited at the vicinity of a shear plane; thereby causing a shear drop to be small.

(2) The grain boundary has a large stress concentration and functions as the propagation path of a crack. The grain boundary density is increased by the refining of crystal grains; thereby relaxing the stress concentration on the grain boundary is decreased and maintaining the toughness.

Although hardening is apt to occur due to the refining of crystal grains, the hardness after quenching shows conventional values. The reason is presumed that V, Nb, Ti, Zr, Ta, and Hf promote the formation of ferrite to reduce the hardness after quenching, and which compensates for the quenching during refining.

The above functions of V, Nb, Ti, Zr, Ta, and Hf are achieved when the total content thereof is 0.02% or more. However, when the content thereof, alone or in total, exceeds 0.50%, the oxidation resistance is decreased at a high temperature, which is disadvantageous in preventing surface defects from forming due to scales formed in the production step of the steel sheet. Thus, the contents are limited to the above conditions.

Nb: 0.01 to 1.00%

Nb is a particularly important element among Ti, V, Nb, and Zr in the present invention. When the Nb content is 1.00% or less alone, the following effects are achieved: the inhibition of softening caused by heating after quenching, the refining of crystal grains of the steel sheet, and the inhibition of grain growth after recrystallization. As a result, the crystal grains are refined so that a shear drop caused by punching before quenching is improved and the toughness and hardness after quenching is maintained. The Nb content is preferably 0.01% or more to achieve the above effects of Nb. However, when the Nb content is too high, the achieved effects are saturated. Thus, the upper limit of the Nb content is 1.00% in view of the cost. Al: 0.100% or less.

Since elemental Al is effective in deoxidation, Al may be contained according to needs. Excessive Al forms AlN compounds, which degrade the formability, especially the elongation. Thus, the upper limit of the Al content is 0.100%.

Co: 0.50% or less, W: 0.50% or less

Elemental Co and W replace elements in the crystal lattice; thereby inhibiting the diffusion or the migration of other elements and improving the oxidation resistance. The mechanism of the improvement in the oxidation resistance is not necessarily clear and is presumed that elemental Cr is inhibited from migrating out of the spinel oxide phase ($FeO.Cr_2O_3$). Each content is preferably 0.01% or more to achieve such effects.

However, when each content is too high, the supply of Cr from the base metal to the spinel oxide phase is inhibited. The upper limit of each content is 0.50%. Ca: 0.0002 to 0.0050%, Mg: 0.0002 to 0.0050% Elemental Ca and Mg control the configuration and the distribution of non-metallic inclusions; thereby improving the machinability of the steel sheet in a cutting step. Each content is preferably 0.0002% or more to achieve such an effect. The mechanism of the effect is not necessarily clear and is presumed to be as follows: peeling off the tip of a tool (namely microchipping), caused by sticking work material to tool material, damage the tool and shorten the lifetime of the tool. Elementary added Ca and Mg precipitate at grain boundaries as non-metallic compounds (sulfides, silicates, oxides, and so on), which lower the affinity for tool material and inhibit sticking. Therefore, microchipping is restrained and the machinability is effectively improved. However, when the content of each of Ca and Mg exceeds 0.0050%, many rust spots due to sulfides, silicates, oxides, and so on of Ca and Mg are formed. Thus, the upper limit of each content is 0.0050% in view of the corrosion resistance.

Other components except the above components are incidentally contained with Fe. According to the present invention, among impurities incidentally contained, the P content is preferably 0.035% or less in view of the corrosion resistance and the inhibition of workability degradation. The S content is preferably 0.020% or less in view of the inhibition of workability degradation. The O content is preferably 0.010% or less in view of the corrosion resistance and toughness. Rare-earth elements may be further contained to improve the corrosion resistance by controlling the configuration of sulfides.

Next, the characteristics of a stainless steel sheet according to the present invention will now be described.

Figure 5A:
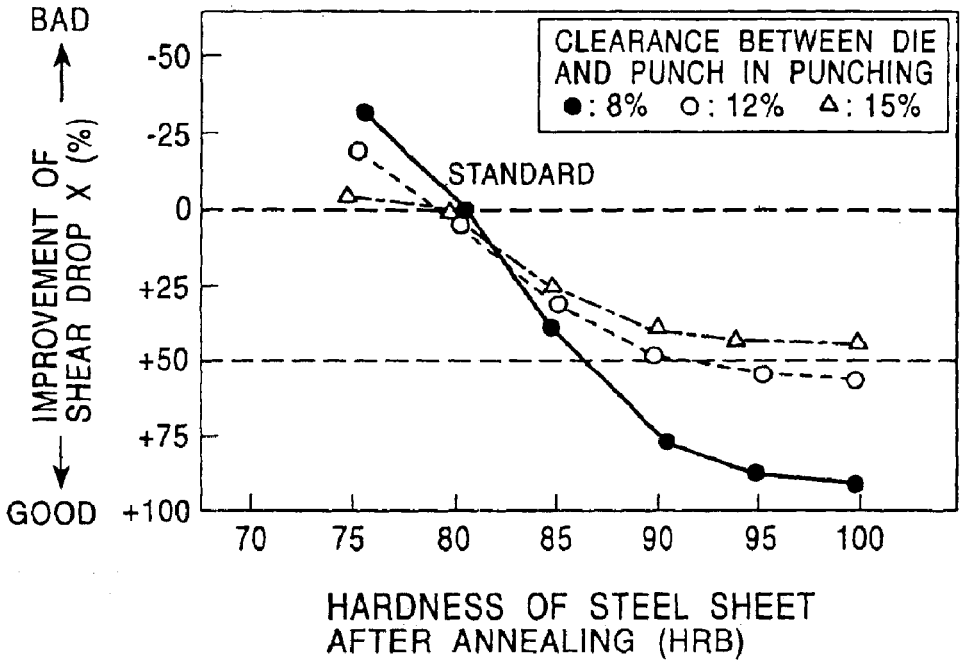
FIG. 5A is a graph showing the relationship between the hardness of a steel sheet after annealing and improvement in a shear drop X arising in blanking.
Figure 5B:
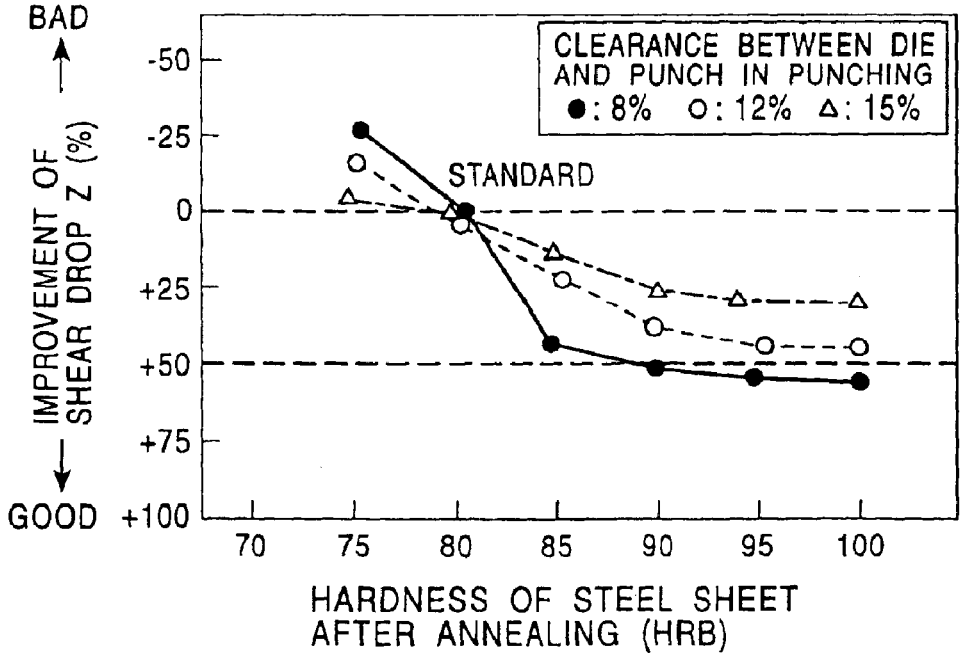
FIG. 5B is a graph showing the relationship between the hardness of a steel sheet after annealing and improvement in a shear drop Z arising in blanking.

As shown in FIGS. 5A and 5B, the punching workability is significantly improved when the steel sheet after annealing has an HRB hardness of 85 or more. However, when the steel sheet has an HRB hardness of 100 or more, there is a problem in that the wear rate of a punching die is accelerated and the elongation of the steel sheet is excessively decreased. According to the present invention, the steel sheet after annealing has an HRB hardness of 85 to 100. The clearance between a punch and a die is preferably small to achieve the effects of the present invention.

The production conditions of the above stainless steel sheet will now be described.

In a production method according to the present invention, molten steel having the above contents is preferably treated in a converter or an electric furnace, is refined by known process such as a vacuum degassing process (an RH process), a VOD process, or an AOD process, and then is cast into a slab by a continuous casting process or an ingot-making process to form steel products.

The steel products are then preferably heated up to 1000° C. to 1300° C. are hot-rolled at a finishing rolling temperature of 900° C. to 1100° C., and are coiled at 700° C. to 900° C. to form a hot-rolled sheet steel having a thickness of 2.0 to 10.0 mm.

Annealing, which is characteristic of the present invention, is subsequent to the hot-rolling. The annealing is an important step to adjust the hardness of the present invention in order to minimize a shear drop arising in a punching step, and is preferably performed by box annealing.

The preferable conditions are as follows:

Heating rate of 20 to 50° C./min.

When the heating rate exceeds 50° C./min., the temperature reaches an excessively high level due to overshooting and the unsuitable hardness arises. On the other hand, when the heating rate is less than 20° C./min., the productivity decreases and the energy loss increases.

Annealing Temperature of 550 to 750° C.

When the annealing temperature is less than 550° C., a homogeneous microstructure can not be achieved due to insufficient annealing and the hardness exceeds the target value. When the annealing temperature exceeds 750° C., the steel sheet is excessively softened.

Annealing Time of 4 to 12 Hours

When the annealing time is less than 4 hours, a homogeneous microstructure can not be achieved due to insufficient annealing. When the annealing time exceeds 12 hours, the crystal grains coarsen; thereby decreasing the toughness and providing undesirable hardness.

Cooling Rate from the Annealing Temperature to 500° C. of 5 to 30° C./min.

When the cooling rate exceeds 30° C./min., large-scale cooling equipment is necessary. When the cooling rate is less than 5° C./min., the corrosion resistance is degraded due to a large amount of deposition of chromium carbide and the productivity decreases.

The following Experiments 1 to 3 were performed to investigate the relationship between the inhibition of softening in the annealing step and the contents of N, Ti, V, Nb, and Zr.

[Experiment 1]

Various steel samples containing 0.050% C, 0.25% Si, 1.45% Mn, 13.00% Cr, 0.20% Cu, 0.60% Ni, 0.040% Mo, 0.10% Ti, 0.10% V (that is, a Ti+V content of 0.20%), and N, the N content varying different, were prepared. The resulting samples were cast into slabs having a thickness of 200 mm by a continuous casting process, heated up to 1150° C., and then formed into hot-rolled steel sheets having a thickness of 5 mm. The finishing temperature of the hot-rolling was 970° C. and the coiling temperature was 770° C. The resulting hot-rolled steel sheets were tempered and annealed at 700° C. for 12 hours, and then sampling was performed. The hardness after quenching and hardness after quenching and tempering were measured. Samples having a size of 100 mm×100 mm were prepared, and quenching was performed under the following conditions: a temperature of 1000° C., a time of 10 minutes, and air-cooling; and then tempering was performed under the following conditions: a temperature of 600° C., a time of 10 minutes, and air-cooling. The Vickers hardness (the Rockwell C scale hardness was also measured for reference) was measured at the middle in the thickness.

The results are shown in FIG. 1. When the N content is 0.005% or more, the degree of a decrease of the hardness after quenching and tempering (the difference between the hardness after quenching and the hardness after quenching and tempering) is small, that is, softening is inhibited. When the N content exceeds the equivalent of nitrides of Ti and V (a N content is more than 0.056%), the dependence of hardness after quenching upon the N content becomes remarkable. Thus, when the N content is from 0.005% to (Ti+V)×14/50, the constant hardness after quenching is achieved and softening after tempering is inhibited.

[Experiment 2]

Other steel samples containing 0.070% C, 0.45% Si, 1.80% Mn, 14.50% Cr, 0.30% Cu, 0.50% Ni, 0.0003% B, 0.20% Nb, 0.10% Zr (that is, a Nb+Zr content of 0.30%), and N, the N contents being different, were prepared. The resulting samples were cast into slabs having a thickness of 200 mm by a continuous casting process, heated up to 1100° C., and then formed into hot-rolled steel sheets having a thickness of 6 mm. The finishing temperature of the hot-rolling was 850° C. and the coiling temperature was 720° C.

The resulting hot-rolled steel sheets were tempered and annealed at 800° C. for 8 hours, and then sampling was performed. The hardness after quenching and hardness after quenching and tempering were measured. Samples having a size of 100 mm×100 mm were prepared, and quenching was performed under the following conditions: a temperature of 1000° C., a time of 10 minutes, air-cooling; and tempering was performed under the following conditions: a temperature of 600° C., a time of 10 minutes, and air-cooling. The Vickers hardness (the Rockwell C scale hardness was also measured for reference) was measured at the middle in the thickness.

Figure 2:
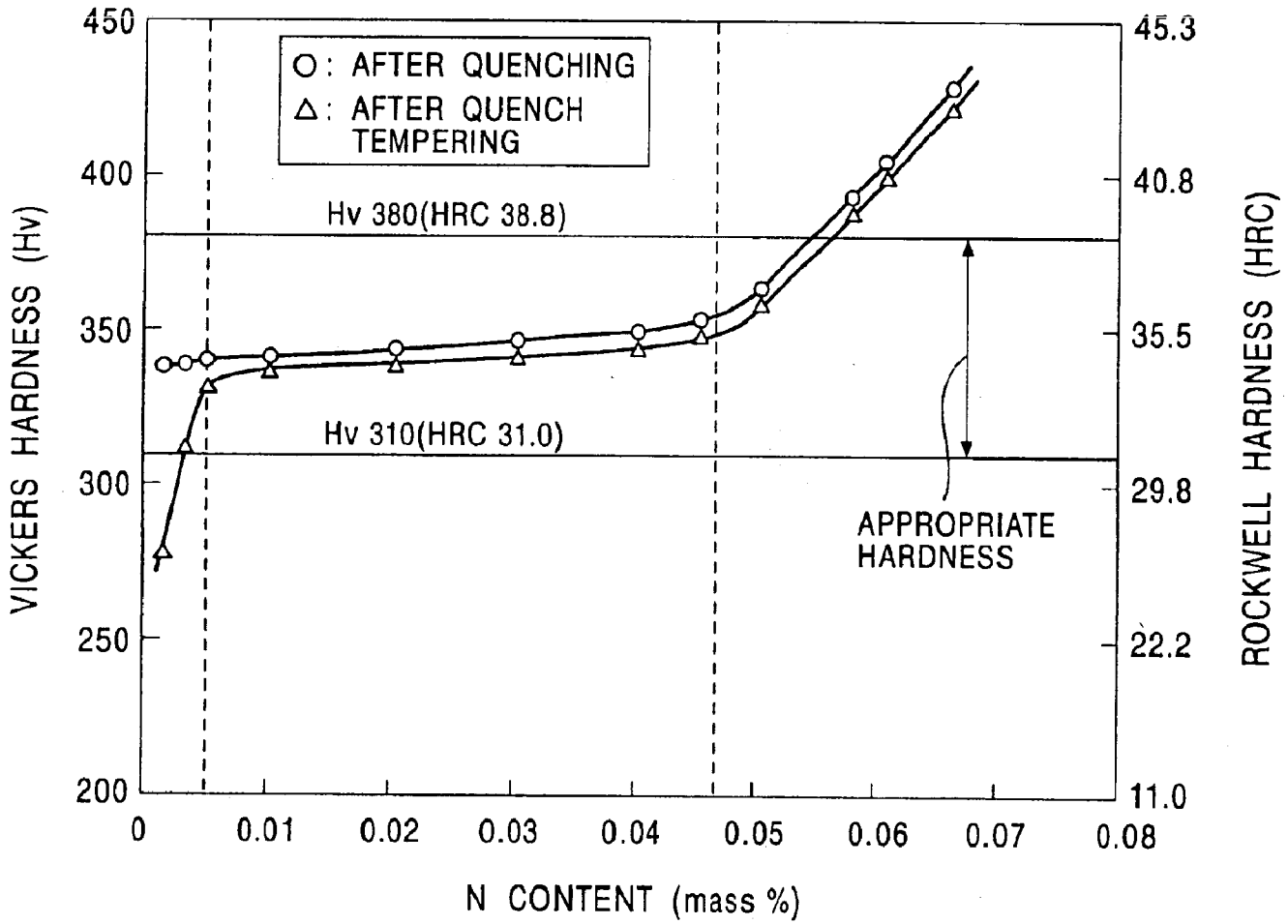
FIG. 2 is a graph showing the relationship between the N content and the hardness after quenching, in a martensitic stainless steel sheet containing Nb and Zr.

The results are shown in FIG. 2. When the N content is 0.005% or more, the degree of decrease of the hardness after quenching and tempering is small, that is, softening is inhibited. When the N content exceeds the equivalent of nitrides of Nb and Zr (a N content is more than 0.047%), the dependence of hardness after quenching upon the N content becomes remarkable. Thus, when the N content is 0.005% to (Nb+Zr)×14/90, constant hardness after quenching is achieved and softening after tempering is inhibited.

[Experiment 3]

Other steel samples containing 0.100% C, 0.20% Si, 2.00% Mn, 11.00% Cr, 0.40% Cu, 0.20% Ni, 0.200% Mo, 0.0007% B, 0.07% Ti, 0.03% V, 0.15% Nb, 0.05% Zr (that is, a Ti+V content of 0.10% and a Nb+Zr content of 0.20%), and N, the N contents being different, were prepared. The resulting samples were cast into slabs having a thickness of 200 mm by a continuous casting process, heated up to 1200° C., and then formed into hot-rolled steel sheets having a thickness of 4.5 mm. The finishing temperature of the hot-rolling was 770° C. and the coiling temperature was 650° C. The resulting hot-rolled steel sheets were tempered and annealed at 840° C. for 10 hours, and then sampling was performed. The hardness after quenching and another hardness after quenching and tempering were measured. Samples having a size of 100 mm×100 mm were prepared, and quenching was performed under the following conditions: a temperature of 100° C., a time of 10 minutes, and air-cooling; and tempering was performed under the following conditions: a temperature of 600° C., a time of 10 minutes, and air-cooling. The Vickers hardness (the Rockwell C scale hardness was also measured for reference) was measured at the middle of the thickness.

Figure 3:
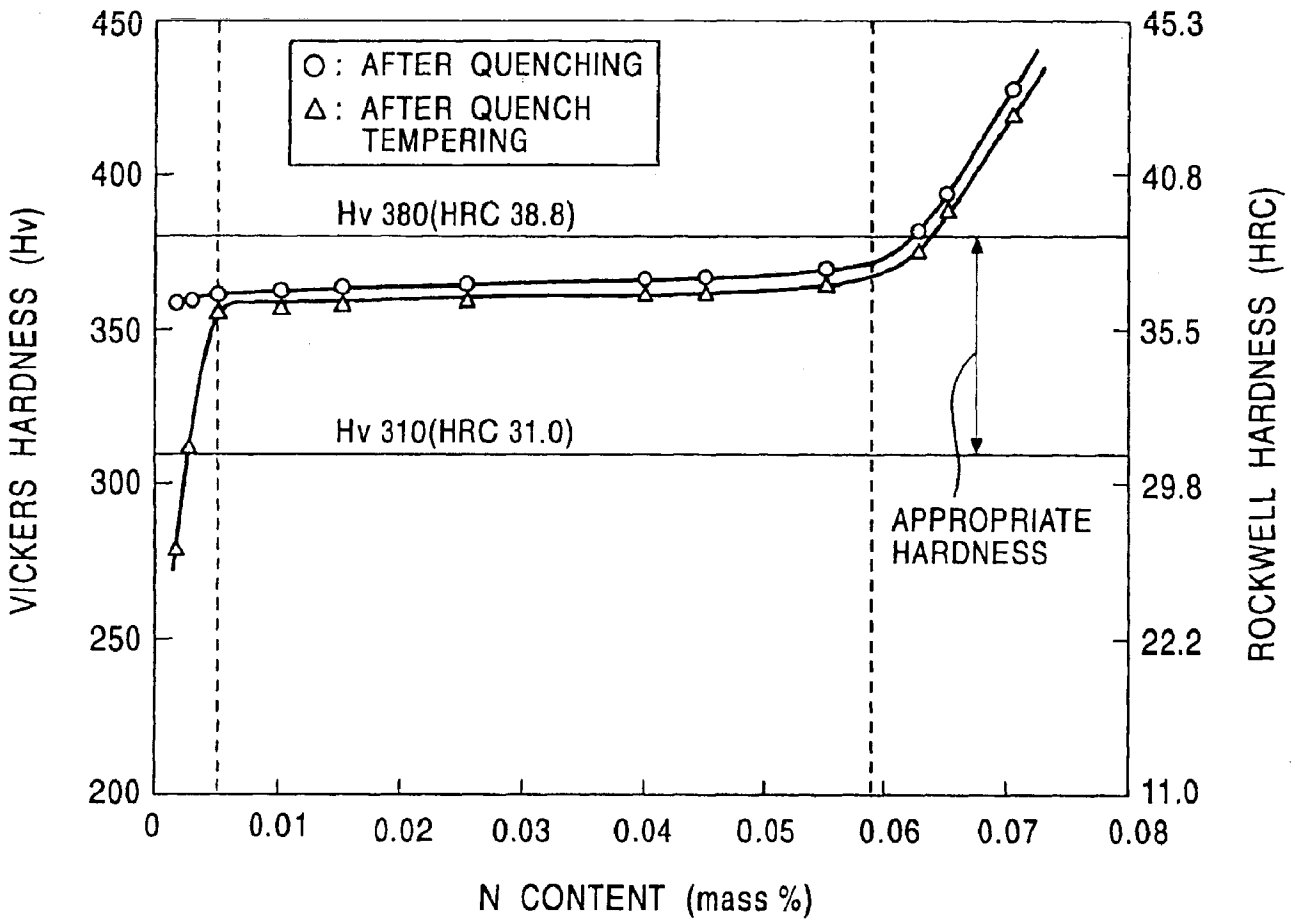
FIG. 3 is a graph showing the relationship between the N content and the hardness after quenching, in a martensitic stainless steel sheet containing Ti, V, Nb, and Zr.

The results are shown in FIG. 3. When the N content is 0.005% or more, the degree of decrease of the hardness after quenching and tempering is small, that is, softening is inhibited. When the N content exceeds the equivalent of nitrides of Ti, V, Nb and Zr (a N content is more than 0.059%), the dependence of hardness after quenching upon the N content becomes remarkable. Thus, when the N content is 0.005% to (Ti+V)×14/50+(Nb+Zr)×14/90, constant hardness after quenching is achieved and softening after tempering is inhibited.

The mechanism of the change in the hardness in response to the N content is not clear and is substantially supposed to be as follows.

Elemental Ti, V, Nb, and Zr form carbides and nitrides. When the N content is 0.005% to (Ti+V)×14/50+(Nb+Zr)×14/90, which is an appropriate value, the nitrides remain in the martensite as a deposit after quenching, because the nitrides are not dissolved and do not form a solid solution by heating for quenching. Thus, the nitrides inhibit the recovering of dislocation in the subsequent tempering step, and softening is accordingly inhibited.

When the N content is less than 0.005%, precipitates are substantially carbides. The carbides are dissolved and increase the hardness of the martensite but do not inhibit softening. When the N content exceeds the equivalent of the nitrides, nitrogen forms a solid solution with the martensite to increase the hardness.

Experiments to improve shear drop arising in a punching step according to the present invention will now be described.

[Experiment 4]

Figure 4:
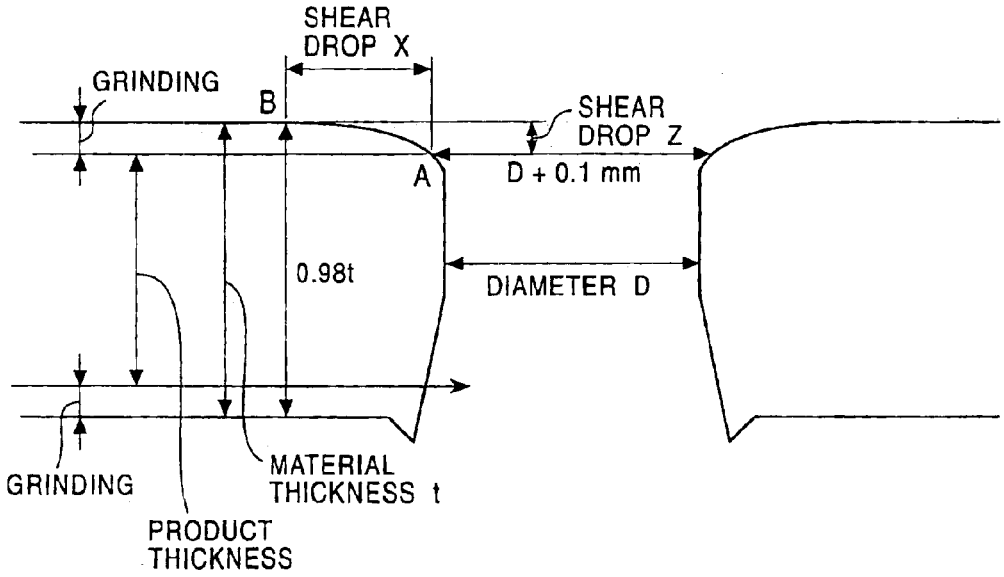
FIG. 4 is a view showing a shear drop X and another shear drop Z arising in blanking.

FIGS. 5A and 5B show the relationship between a shear drop arising in blanking and the hardness of a material, for a low carbon martensitic stainless steel sheet before quenching (the standard being a sheet containing 0.060% C, 1.55% Mn, 12.20% Cr, and 0.013% N and the hardness being adjusted by annealing at different temperatures). In the experiments, three different clearances (((a distance between a punch and die)/thickness)×100%) were used. Referring to FIG. 4, the shear drop was evaluated according to an improvement calculated according to the following formula, a shear drop X and another shear drop Z. The shear drop X is a horizontal distance between position A of diameter D+0.1 mm and another position B of thickness t×0.98, and the shear drop Z is a perpendicular distance between position A and position B.

[(The shear drop of a sheet having an HRB hardness of 80−a measured shear drop)/(the shear drop of the sheet having a HRB hardness of 80)]×100 (%).

As shown in FIGS. 5A and 5B, when the clearance is appropriate (8% or less) and the HRB hardness is 85 or more, the improvement of the shear drop is 40% or more, that is, the size of the shear drop is improved into one half or less. The effect is saturated at an HRB hardness of 100.

According to the above results, it is should be clear that the steel sheet after annealing is required to have an HRB hardness (a hardness of Rockwell scale B) of 85 to 100 in order to improve the shear drop arising in blanking.

[Experiment 5]

Figure 6:
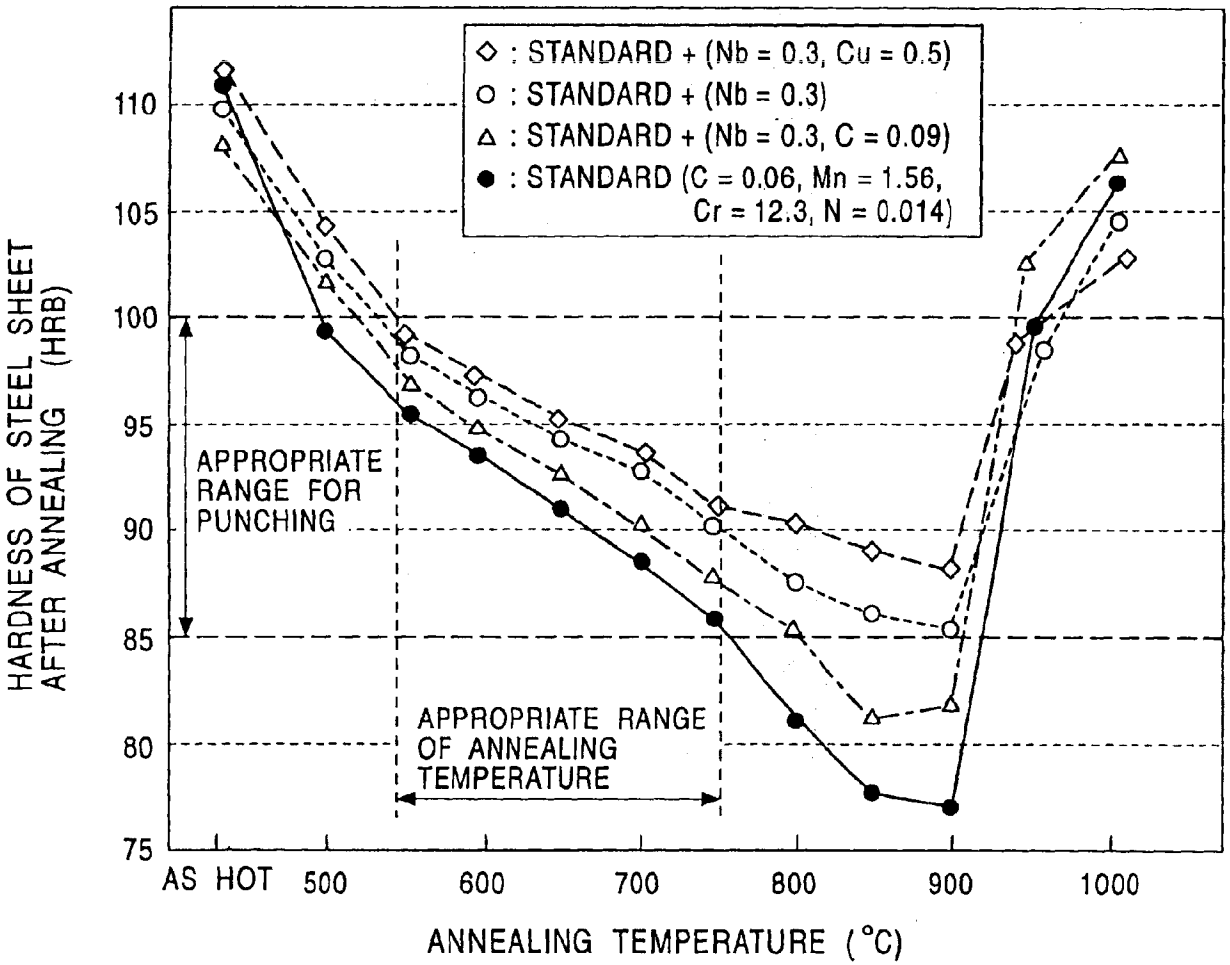
FIG. 6 is a graph showing the relationship between the hardness of a steel sheet after annealing and the annealing temperature.

Another steel sample containing 0.060% C, 1.56% Mn, 12.30% Cr, and 0.014% N was prepared as a standard, and other samples were prepared by further adding Nb, Cu, and C to the above steel sample. The samples were processed into hot-rolled steel sheets having a thickness of 5.5 mm. The steel sheets were annealed at different temperatures in the range of 500° C. to 1000° C. and changes in the hardness of the steel sheets were measured. The results are shown in FIG. 6. As shown in FIG. 6, the hardness of each steel sheet decreases as the annealing temperature increases, and an appropriate annealing temperature is 550° C. to 750° C. in order to provide all the steel sheets with an HRB hardness of 85 to 100.

The present invention has been completed according to the above results.

EXAMPLE 1

Steel samples D to O having the compositions shown in Table 1 were prepared, cast into slabs-having a thickness of 200 mm by a continuous casting process, heated up to 1150° C., and then processed into hot-rolled steel sheets having a thickness of 4 mm or 10 mm. The finishing temperature of the hot-rolling was 930° C. and the coiling temperature was 740° C. The resulting hot-rolled steel sheets were tempered and annealed at 820° C. for 10 hours, and then sampling was performed. The hardness after quenching and another hardness after quenching and tempering were measured for each sample. Samples having a size of 100 mm×100 mm were prepared, and quenching was performed under the following conditions: a temperature of 1000° C., a time of 10 minutes, and air-cooling; and tempering subsequent to quenching was performed under the following conditions: a temperature of 600° C., a time of 10 minutes, and air-cooling. The Vickers hardness (the Rockwell C scale hardness was also measured for reference purposes) was measured at the middle in the thickness.

The results are shown in Table 2. As shown in Table 2, the steel samples D to L (this invention) after quenching have an appropriate hardness, and the appropriate hardness is maintained after the tempering treatment; hence, these samples are suitable for the material of motorcycle disk brakes. When comparing sheets having a thickness of 4 mm with other sheets having 10 mm for the steel samples E to J, the sheets having a thickness of 10 mm in the steel samples E, F, I, and J which contain an appropriate content of B have substantially the same hardness as those of the sheets having a thickness of 4 mm, that is, the hardenability is improved.

On the other hand, a steel sample M (a comparative sample) having a low N content and another sample O (a comparative sample) not containing Ti, V, Nb, and Zr are seriously softened after tempering and can not maintain an appropriate hardness. Another steel sample N (a comparative sample) containing excessive N has a high hardness out of the appropriate range.

EXAMPLE 2

Steel samples having the compositions shown in Tables 3 and 4 were prepared, cast into slabs having a thickness of 200 mm by a continuous casting process, heated up to 1150° C., processed into hot-rolled steel sheets having a thickness of mm, and then annealed at 800° C. Using the above sheets, test pieces (a thickness of 5 mm, a width of 50 mm, and a length of 50 mm) for the Rockwell scale C hardness test (Vickers hardness (Hv) was also measured for reference purposes) after quenching, other test pieces (a thickness of mm, a width of 5 mm, and a length of 55 mm) for a subsize Charpy impact test in conformity with JIS Z 2202 and a corrosion resistance test (salt spay) were prepared. The quenching temperature was 800° C. to 1050° C. Furthermore, other samples for measuring the blanking workability (the shear drop in a blanking step) before quenching, the bending workability, the machinability (the drilling workability), and the oxidation resistance during heating were also prepared. No. 3 test pieces (a thickness of 5 mm, a width of 20 mm, and a length of 150 mm) for the bending test in conformity with JIS Z 2204 were used. Test pieces (a thickness of 5 mm, a width of 100 $\mu$m, and a length of 100 mm) were used for the oxidation resistance in heating. Salt-spray test pieces (a thickness of 5 mm, a width of 60 mm, and a length of 80 mm) in conformity with JIS Z 2371 were used for the corrosion resistance test.

Each test of the blanking workability, the bending workability, the machinability, the oxidation resistance, and corrosion resistance was performed according to the following procedure.

Blanking workability: disks having a diameter of 150 mm and 50 mm were punched in the hot-rolled steel sheets, and the shear drops Z and X shown in FIG. 4 were measured using photographs taken at the cross section. The shear drops Z and X were measured according to the same procedure as in Experiment 4.

Bending workability: test pieces were bent at a 2.5-mm radius into angles of 90° and 180° and the test pieces were evaluated as follows: a test piece having no cracks was rated as A, one having a crack of 0.5 mm or less was rated as B, and one having a crack of more than 0.5 mm was rated as C.

Machinability (the drilling workability): using a drill (a diameter of 12 mm) made of a high-speed steel, repeated drilling was performed under the following conditions: a cutting rate of 0.20 m/s and 0.35 m/s, a feeding rate of 0.15 mm/rev., a hole depth of 20 mm, and no cutting oil; and an integrated hole length which one drill is capable of drilling was measured.

Oxidation resistance: the samples were heated at 850° C. and 1000° C. for 10 hours in air, and the increased weight per unit area by oxidation was measured.

Corrosion resistance: in conformity with JIS Z 2371, a salt-spray test was performed for 4 hours or 12 hours and the test pieces were evaluated according to the presence or absence of the formation of rust, that is, the number of rust spots on a single side was counted and evaluated as follows: the test piece having no rust spots was rated as A, one having between 1 to 4 rust spots was rated as B, and one having 5 or more rust spots was rated as C.

The test results are shown in Tables 5 to 13.

All Examples annealed at 850° C. or more exhibit a greater Rockwell scale C hardness (the Vickers hardness (Hv) was also measured for reference purposes) than those of Comparative Examples, and also exhibit a greater toughness represented by impact absorption energy than those of Comparative Examples. All Examples have excellent punching workability due to the small shear drop and excellent bending workability. The bending workability is further improved by adding elemental B. Examples exhibit the excellent oxidation resistance with slight increase in weight during the test. Furthermore, Examples exhibit good drilling workability and corrosion resistance, and Examples containing Mo exhibit particularly excellent corrosion resistance.

EXAMPLE 3

Steel samples having the composition shown in Table 14 were prepared and cast into slabs having a thickness of 200 mm by a continuous casting process, heated up to 1150° C., and processed into hot-rolled steel sheets having a thickness of 5 mm. The hot-rolled steel sheets were then annealed under the conditions shown in Table 15. Using the above sheets, test pieces used for measuring the Rockwell scale C hardness and other test pieces used for measuring the punching workability (the shear drop arising in blanking) before annealing were prepared. The punching workability test was performed by punching a ring-shaped disk having an outer diameter of 150 mm and an inner diameter of 50 mm in the hot-rolled steel sheet, and the shear drops X and Z were measured for the punched cross section of the inner diameter side. The method of measuring the shear drop was the same as Experiment 4 and Example 2.

The test results are shown in Table 15. The steel samples which have the composition according to the present invention and are annealed at the temperature of the present invention exhibit a hardness suitable for the blanking. Examples also exhibit excellent punching workability due to the slight shear drop.

INDUSTRIAL APPLICABILITY

According to the present invention, in a low carbon martensitic stainless steel sheet used only after quenching, softening caused by a high temperature arising during the use of a disk brake is effectively inhibited. Furthermore, the present invention provides a martensitic stainless steel of which the characteristics such as the punching workability and the bending workability before quenching are improved. Thus, the product yield of the process and the productivity are improved, and the production cost is extremely decreased. Furthermore, adjusting the annealing conditions of the steel sheet after hot-rolling to an appropriate range provides a constant production of a steel sheet having a hardness suitable for blanking. As a result, the shear drop in blanking is reduced and the grinding allowance is subsequently reduced; thereby improving the product yield and the productivity and reducing the production cost significantly.

TABLE 1

| Steel No. | Chemical Component (mass %) C | Si | Mn | Cr | Cu | Ni | Ti | V | Nb | Zr | N | Mo | B | (Ti + V) 14/50 + (Nb + Zr) 14/90 | Remarks |
|---|---|---|---|---|---|---|---|---|---|---|---|---|---|---|---|
| D | 0.030 | 0.14 | 1.69 | 12.11 | 0.01 | 0.12 | 0.20 | — | — | — | 0.040 | 0.063 | 0.0005 | 0.056 | Example |
| E | 0.055 | 0.16 | 1.09 | 10.80 | 0.02 | 0.05 | — | 0.12 | — | — | 0.015 | 0.707 | 0.0008 | 0.034 | Example |
| F | 0.076 | 0.15 | 1.23 | 14.70 | 0.10 | 0.20 | — | — | 0.03 | — | 0.041 | 0.011 | 0.0002 | 0.047 | Example |
| G | 0.061 | 0.15 | 1.36 | 13.02 | 0.20 | 0.33 | — | — | — | 0.07 | 0.008 | 0.024 | — | 0.011 | Example |
| H | 0.031 | 0.25 | 2.00 | 13.09 | 0.10 | 0.05 | 0.20 | 0.12 | 0.30 | 0.07 | 0.088 | 0.656 | — | 0.147 | Example |
| I | 0.052 | 0.15 | 1.23 | 10.88 | 0.01 | 0.12 | — | — | 0.08 | 0.04 | 0.010 | 0.039 | 0.0003 | 0.019 | Example |
| J | 0.052 | 0.28 | 2.00 | 12.26 | 0.005 | 0.45 | 0.30 | 0.08 | — | — | 0.088 | 0.100 | 0.0010 | 0.106 | Example |
| K | 0.050 | 0.25 | 2.12 | 12.54 | 0.006 | 0.86 | — | 0.05 | 0.25 | — | 0.030 | 0.981 | — | 0.053 | Example |
| L | 0.034 | 0.47 | 2.30 | 13.15 | 0.41 | 0.70 | 0.20 | 0.10 | — | — | 0.007 | 0.050 | 0.0007 | 0.084 | Example |
| M | 0.077 | 0.30 | 1.55 | 10.97 | 0.12 | 0.30 | — | 0.12 | 0.22 | — | 0.002 | 0.652 | 0.0007 | 0.068 | Comparative Example |
| N | 0.053 | 0.20 | 1.42 | 11.37 | 0.11 | 0.10 | 0.20 | — | — | — | 0.079 | 0.305 | 0.0002 | 0.056 | Comparative Example |
| O | 0.052 | 0.12 | 2.04 | 12.33 | 0.05 | 0.03 | — | — | — | — | 0.020 | 0.703 | 0.0004 | — | Comparative Example |

TABLE 2

| Steel No. | Thickness (mm) | Vickers Hardness Hv (Rockwell Hardness HRC) After Quenching | After Quenching and Tempering | Remarks |
|---|---|---|---|---|
| D | 4 | 320(32.2) | 321(32.3) | Example |
| E | 4 | 354(35.9) | 342(34.6) | Example |
| | 10 | 353(35.8) | 340(34.4) | Example |
| F | 4 | 367(37.4) | 354(35.9) | Example |
| | 10 | 367(37.4) | 351(35.6) | Example |
| G | 4 | 363(36.9) | 351(33.6) | Example |
| | 10 | 348(35.3) | 333(33.6) | Example |
| H | 4 | 337(34.1) | 330(33.3) | Example |
| | 10 | 314(31.5) | 311(31.1) | Example |
| I | 4 | 351(35.6) | 332(33.5) | Example |
| | 10 | 349(35.4) | 331(33.4) | Example |

TABLE 2-continued

| Steel No. | Thickness (mm) | Vickers Hardness Hv (Rockwell Hardness HRC) After Quenching | After Quenching and Tempering | Remarks |
|---|---|---|---|---|
| J | 4 | 353(35.8) | 343(34.7) | Example |
| | 10 | 350(35.5) | 342(34.6) | Example |
| K | 4 | 350(35.5) | 335(33.9) | Example |
| L | 4 | 320(32.2) | 311(31.1) | Example |
| M | 4 | 374(38.1) | 260(24.0) | Comparative Example |
| N | 4 | 442(44.7) | 433(43.9) | Comparative Example |
| O | 4 | 345(35.0) | 249(22.0) | Comparative Example |

TABLE 3

| | No. | Chemical Component (mass %) C | N | Si | Mn | P | S | Ni | Cu | Cr | Al | V |
|---|---|---|---|---|---|---|---|---|---|---|---|---|
| C.E.* | 1 | 0.056 | 0.014 | 0.26 | 1.55 | 0.028 | 0.005 | 0.23 | 0.02 | 12.34 | — | — |
| | 2 | 0.134 | 0.035 | 0.34 | 1.51 | 0.017 | 0.003 | 0.09 | 0.01 | 12.79 | 0.020 | — |
| | 3 | 0.203 | 0.028 | 0.48 | 0.50 | 0.019 | 0.002 | 0.21 | 0.02 | 12.91 | 0.002 | — |
| | 4 | 0.326 | 0.038 | 0.31 | 0.56 | 0.022 | 0.004 | 0.11 | 0.01 | 13.34 | 0.008 | — |
| | 5 | 0.301 | 0.013 | 0.53 | 0.45 | 0.023 | 0.003 | 0.05 | 0.01 | 13.01 | 0.005 | — |
| Example | A01 | 0.034 | 0.014 | 0.45 | 2.02 | 0.014 | 0.003 | 0.07 | 0.01 | 12.25 | 0.002 | 0.02 |
| | A02 | 0.053 | 0.045 | 0.30 | 1.13 | 0.029 | 0.002 | 0.41 | 0.21 | 13.04 | 0.033 | 0.13 |
| | A03 | 0.056 | 0.013 | 0.27 | 1.90 | 0.030 | 0.007 | 0.21 | 0.01 | 12.16 | 0.002 | 0.46 |
| | A11 | 0.058 | 0.024 | 0.37 | 1.53 | 0.022 | 0.003 | 0.08 | 0.01 | 12.73 | 0.001 | 0.01 |
| | A12 | 0.052 | 0.016 | 0.40 | 1.56 | 0.018 | 0.003 | 0.22 | 0.01 | 12.69 | 0.095 | — |
| | A13 | 0.052 | 0.018 | 0.41 | 1.71 | 0.019 | 0.006 | 0.26 | 0.01 | 12.32 | 0.002 | — |
| | A21 | 0.061 | 0.031 | 0.25 | 1.20 | 0.027 | 0.003 | 0.06 | 0.01 | 13.89 | 0.002 | — |
| | A22 | 0.033 | 0.012 | 0.31 | 2.32 | 0.024 | 0.004 | 0.51 | 0.01 | 12.80 | 0.052 | — |
| | A23 | 0.054 | 0.011 | 0.42 | 1.54 | 0.016 | 0.003 | 0.10 | 0.11 | 10.39 | 0.002 | 0.01 |
| | A31 | 0.060 | 0.013 | 0.26 | 1.66 | 0.017 | 0.006 | 0.07 | 0.02 | 11.01 | 0.002 | — |
| | A32 | 0.051 | 0.014 | 0.27 | 1.69 | 0.024 | 0.004 | 0.11 | 0.01 | 12.25 | 0.002 | — |
| | A33 | 0.070 | 0.012 | 0.26 | 1.34 | 0.014 | 0.003 | 0.07 | 0.01 | 12.44 | 0.012 | 0.01 |

TABLE 3-continued

| | | | | | | | | | | | | |
|---|---|---|---|---|---|---|---|---|---|---|---|---|
| | A41 | 0.046 | 0.019 | 0.36 | 1.95 | 0.018 | 0.005 | 0.13 | 0.03 | 14.34 | 0.014 | — |
| | A42 | 0.055 | 0.014 | 0.25 | 1.56 | 0.022 | 0.007 | 0.23 | 0.02 | 12.36 | 0.010 | — |
| | A51 | 0.052 | 0.015 | 0.26 | 1.61 | 0.023 | 0.006 | 0.27 | 0.02 | 12.34 | 0.003 | — |
| | A52 | 0.061 | 0.014 | 0.24 | 1.64 | 0.016 | 0.005 | 0.11 | 0.01 | 10.98 | 0.069 | — |
| | A61 | 0.054 | 0.024 | 0.26 | 1.53 | 0.028 | 0.007 | 0.18 | 0.02 | 12.21 | 0.001 | 0.17 |
| | A62 | 0.056 | 0.012 | 0.29 | 1.85 | 0.023 | 0.005 | 0.17 | 0.01 | 10.27 | 0.004 | 0.06 |
| | B01 | 0.052 | 0.017 | 0.29 | 1.58 | 0.028 | 0.006 | 0.21 | 0.01 | 13.81 | 0.014 | 0.06 |
| | B02 | 0.061 | 0.015 | 0.28 | 2.40 | 0.018 | 0.003 | 0.21 | 0.11 | 12.12 | 0.001 | 0.11 |
| | B03 | 0.050 | 0.014 | 0.38 | 1.56 | 0.028 | 0.004 | 0.13 | 0.02 | 12.25 | 0.002 | 0.30 |
| | B11 | 0.053 | 0.024 | 0.27 | 1.54 | 0.019 | 0.005 | 0.12 | 0.01 | 13.22 | 0.002 | 0.01 |
| | B21 | 0.051 | 0.018 | 0.25 | 1.58 | 0.017 | 0.002 | 0.29 | 0.01 | 13.67 | 0.001 | 0.01 |
| | B31 | 0.050 | 0.019 | 0.37 | 1.56 | 0.020 | 0.004 | 0.25 | 0.01 | 12.27 | 0.002 | — |
| | B41 | 0.053 | 0.016 | 0.26 | 1.68 | 0.028 | 0.005 | 0.21 | 0.02 | 12.64 | 0.012 | 0.01 |
| | B51 | 0.061 | 0.014 | 0.46 | 1.53 | 0.015 | 0.006 | 0.24 | 0.03 | 12.14 | 0.002 | — |
| | B61 | 0.056 | 0.017 | 0.32 | 1.55 | 0.023 | 0.005 | 0.13 | 0.02 | 11.95 | 0.002 | 0.07 |
| | C01 | 0.069 | 0.014 | 0.29 | 1.53 | 0.021 | 0.003 | 0.24 | 0.02 | 12.14 | 0.002 | 0.37 |
| | C02 | 0.054 | 0.013 | 0.32 | 1.53 | 0.026 | 0.003 | 0.22 | 0.02 | 14.14 | 0.048 | 0.10 |
| | C03 | 0.072 | 0.015 | 0.28 | 1.54 | 0.025 | 0.007 | 0.52 | 0.01 | 12.18 | 0.001 | 0.08 |

| | | Chemical Component (mass %) | | | | | | | | | |
|---|---|---|---|---|---|---|---|---|---|---|---|
| No. | | Nb | Ti | Zr | Ta | Hf | V + Nb + Ti + Zr + Ta + Hf | Mo | B | Co, W | Ca, Mg |
| C.E.* | 1 | — | — | — | — | — | — | — | — | — | — |
| | 2 | — | — | — | — | — | — | — | — | — | — |
| | 3 | — | — | — | — | — | — | — | — | — | — |
| | 4 | — | — | — | — | — | — | — | — | — | — |
| | 5 | — | — | — | — | — | — | — | — | — | — |
| Example | A01 | — | — | — | — | — | 0.02 | — | — | — | — |
| | A02 | — | 0.01 | — | — | — | 0.14 | — | — | — | — |
| | A03 | 0.01 | — | — | — | — | 0.47 | — | — | — | — |
| | A11 | 0.02 | — | — | — | — | 0.03 | — | — | — | — |
| | A12 | 0.21 | — | — | — | — | 0.21 | — | — | — | — |
| | A13 | 0.31 | — | — | — | — | 0.31 | — | — | — | — |
| | A21 | 0.01 | 0.09 | — | — | — | 0.10 | — | — | — | — |
| | A22 | — | 0.16 | — | — | — | 0.16 | — | — | — | — |
| | A23 | — | 0.42 | — | — | — | 0.43 | — | — | — | — |
| | A31 | — | — | 0.05 | — | — | 0.05 | — | — | — | — |
| | A32 | — | — | 0.17 | — | — | 0.17 | — | — | — | — |
| | A33 | 0.01 | — | 0.29 | — | — | 0.31 | — | — | — | — |
| | A41 | 0.01 | — | — | 0.24 | — | 0.25 | — | — | — | — |
| | A42 | — | — | — | 0.15 | — | 0.15 | — | — | — | — |
| | A51 | — | — | — | — | 0.30 | 0.30 | — | — | — | — |
| | A52 | — | — | — | — | 0.24 | 0.24 | — | — | — | — |
| | A61 | 0.03 | 0.06 | 0.04 | 0.02 | 0.05 | 0.37 | — | — | — | — |
| | A62 | 0.07 | 0.03 | 0.03 | 0.05 | 0.02 | 0.26 | — | — | — | — |
| | B01 | — | — | — | — | — | 0.06 | 0.012 | — | — | — |
| | B02 | — | — | — | — | — | 0.11 | 0.107 | — | — | — |
| | B03 | — | — | — | — | — | 0.30 | 0.421 | — | — | — |
| | B11 | 0.16 | — | — | — | — | 0.17 | 0.261 | — | — | — |
| | B21 | 0.01 | 0.31 | — | — | — | 0.33 | 0.201 | — | — | — |
| | B31 | 0.01 | — | 0.19 | — | — | 0.20 | 0.014 | — | — | — |
| | B41 | — | — | — | 0.31 | — | 0.32 | 0.017 | — | — | — |
| | B51 | — | — | — | — | 0.21 | 0.21 | 0.114 | — | — | — |
| | B61 | 0.03 | 0.09 | 0.02 | 0.03 | 0.04 | 0.28 | 0.194 | — | — | — |
| | C01 | — | — | — | — | — | 0.37 | — | 0.0008 | — | — |
| | C02 | — | — | — | — | — | 0.10 | — | 0.0039 | — | — |
| | C03 | — | — | — | — | — | 0.08 | — | 0.0017 | — | — |

C.E.*: Comparative Example

TABLE 4

| | | Chemical Component (mass %) | | | | | | | | | | |
|---|---|---|---|---|---|---|---|---|---|---|---|---|
| No. | | C | N | Si | Mn | P | S | Ni | Cu | Cr | Al | V |
| Example | C11 | 0.061 | 0.010 | 0.44 | 1.71 | 0.025 | 0.004 | 0.13 | 0.01 | 13.11 | 0.001 | — |
| | C21 | 0.021 | 0.038 | 0.32 | 1.89 | 0.015 | 0.007 | 0.23 | 0.01 | 13.09 | 0.014 | — |
| | C31 | 0.059 | 0.015 | 0.29 | 1.58 | 0.020 | 0.003 | 0.18 | 0.01 | 13.17 | 0.019 | 0.01 |
| | C41 | 0.057 | 0.013 | 0.36 | 1.75 | 0.012 | 0.006 | 0.11 | 0.01 | 12.38 | 0.022 | 0.01 |
| | C51 | 0.053 | 0.021 | 0.23 | 1.52 | 0.020 | 0.005 | 0.16 | 0.02 | 12.44 | 0.034 | — |
| | C61 | 0.063 | 0.015 | 0.46 | 1.61 | 0.022 | 0.005 | 0.09 | 0.01 | 14.34 | 0.004 | 0.03 |

TABLE 4-continued

| | | | | | | | | | | | |
|---|---|---|---|---|---|---|---|---|---|---|---|
| D01 | 0.054 | 0.016 | 0.32 | 1.53 | 0.026 | 0.003 | 0.22 | 0.02 | 10.84 | 0.001 | 0.10 |
| D02 | 0.031 | 0.020 | 0.33 | 1.94 | 0.025 | 0.007 | 0.48 | 0.31 | 12.98 | 0.002 | 0.08 |
| D03 | 0.072 | 0.015 | 0.28 | 1.64 | 0.025 | 0.007 | 0.48 | 0.01 | 12.18 | 0.002 | 0.28 |
| D11 | 0.054 | 0.025 | 0.28 | 1.60 | 0.021 | 0.003 | 0.22 | 0.21 | 3.33 | 0.001 | 0.01 |
| D21 | 0.058 | 0.019 | 0.27 | 1.57 | 0.021 | 0.004 | 0.23 | 0.01 | 13.00 | 0.002 | — |
| D31 | 0.053 | 0.031 | 0.29 | 1.59 | 0.022 | 0.008 | 0.20 | 0.01 | 12.40 | 0.024 | 0.01 |
| D41 | 0.026 | 0.044 | 0.28 | 2.12 | 0.031 | 0.003 | 0.21 | 0.02 | 12.34 | 0.002 | — |
| D51 | 0.053 | 0.022 | 0.30 | 1.58 | 0.028 | 0.003 | 0.25 | 0.02 | 12.33 | 0.002 | — |
| D61 | 0.054 | 0.014 | 0.31 | 1.58 | 0.021 | 0.003 | 0.24 | 0.01 | 12.23 | 0.004 | 0.13 |
| E01 | 0.061 | 0.012 | 0.42 | 1.53 | 0.022 | 0.004 | 0.21 | 0.01 | 14.23 | 0.005 | 0.01 |
| E11 | 0.020 | 0.034 | 0.30 | 1.42 | 0.024 | 0.004 | 0.21 | 0.01 | 12.04 | 0.003 | 0.03 |
| F01 | 0.051 | 0.013 | 0.39 | 1.65 | 0.024 | 0.003 | 0.08 | 0.02 | 11.90 | 0.004 | 0.01 |
| F11 | 0.053 | 0.013 | 0.28 | 1.71 | 0.029 | 0.007 | 0.07 | 0.01 | 12.10 | 0.004 | 0.03 |
| G01 | 0.040 | 0.017 | 0.26 | 1.95 | 0.030 | 0.006 | 0.15 | 0.02 | 12.11 | 0.004 | — |
| H01 | 0.049 | 0.020 | 0.29 | 1.54 | 0.028 | 0.003 | 0.07 | 0.01 | 12.17 | 0.016 | 0.20 |
| J01 | 0.050 | 0.013 | 0.27 | 1.57 | 0.028 | 0.004 | 0.15 | 0.01 | 12.09 | 0.052 | — |
| K01 | 0.053 | 0.016 | 0.29 | 1.55 | 0.028 | 0.003 | 0.06 | 0.01 | 12.42 | 0.011 | 0.06 |
| L01 | 0.054 | 0.015 | 0.33 | 1.61 | 0.026 | 0.005 | 0.21 | 0.01 | 12.11 | 0.003 | 0.03 |
| L02 | 0.048 | 0.015 | 0.27 | 1.59 | 0.024 | 0.005 | 0.23 | 0.01 | 12.24 | 0.001 | 0.02 |

| | | Chemical Component (mass %) | | | | | | | | | |
|---|---|---|---|---|---|---|---|---|---|---|---|
| No. | | Nb | Ti | Zr | Ta | Hf | V + Nb + Ti + Zr + Ta + Hf | Mo | B | Co, W | Ca, Mg |
| Example | C11 | 0.32 | — | — | — | — | 0.32 | — | 0.0031 | — | — |
| | C21 | — | 0.29 | — | — | — | 0.29 | — | 0.0028 | — | — |
| | C31 | — | — | 0.23 | — | — | 0.24 | — | 0.0018 | — | — |
| | C41 | — | — | — | 0.22 | — | 0.23 | — | 0.0021 | — | — |
| | C51 | — | — | — | — | 0.26 | 0.26 | — | 0.0019 | — | — |
| | C61 | 0.07 | 0.02 | 0.05 | 0.06 | 0.04 | 0.27 | — | 0.0024 | — | — |
| | D01 | — | — | — | — | — | 0.10 | 0.095 | 0.0028 | — | — |
| | D02 | — | — | — | — | — | 0.08 | 0.187 | 0.0016 | — | — |
| | D03 | 0.01 | — | — | — | — | 0.29 | 0.061 | 0.0004 | — | — |
| | D11 | 0.08 | — | — | — | — | 0.09 | 0.050 | 0.0019 | — | — |
| | D21 | 0.01 | 0.19 | — | — | — | 0.20 | 0.084 | 0.0021 | — | — |
| | D31 | 0.01 | — | 0.35 | — | — | 0.37 | 0.091 | 0.0015 | — | — |
| | D41 | — | — | — | 0.22 | — | 0.22 | 0.111 | 0.0019 | — | — |
| | D51 | — | — | — | — | 0.26 | 0.26 | 0.329 | 0.0033 | — | — |
| | D61 | 0.05 | 0.08 | 0.05 | 0.01 | — | 0.32 | 0.019 | 0.0022 | — | — |
| | E01 | 0.03 | 0.09 | 0.03 | 0.01 | — | 0.17 | — | — | Co: 0.39 | — |
| | E11 | 0.05 | 0.07 | 0.05 | 0.01 | — | 0.21 | — | — | W: 0.19 | — |
| | F01 | 0.01 | 0.05 | 0.08 | 0.01 | 0.01 | 0.17 | — | — | — | Ca: 0.0010 |
| | F11 | — | — | 0.05 | 0.01 | 0.16 | 0.25 | — | — | — | Mg: 0.0025 |
| | G01 | 0.05 | — | 0.04 | 0.18 | — | 0.27 | 0.013 | — | Co: 0.02 | — |
| | H01 | 0.04 | — | — | 0.01 | 0.01 | 0.26 | 0.127 | — | — | Ca: 0.0029 |
| | J01 | 0.03 | — | 0.27 | 0.01 | — | 0.31 | — | 0.0013 | W: 0.09 | — |
| | K01 | 0.01 | 0.12 | 0.06 | 0.08 | 0.05 | 0.38 | — | 0.0021 | — | Mg: 0.0003 |
| | L01 | — | — | — | 0.01 | — | 0.04 | 0.021 | 0.0009 | Co: 0.11 | Mg: 0.0012 |
| | L02 | 0.05 | 0.06 | 0.05 | 0.06 | — | 0.24 | 0.187 | 0.0018 | W: 0.14 | Ca: 0.0048 |

TABLE 5

| Quenching Temperature | | Rockwell Hardness HRC (Vickers Hardness Hv) | | | | | | Absorbed Energy at Room Temperature (J/cm$^2$) | | | | | |
|---|---|---|---|---|---|---|---|---|---|---|---|---|---|
| No. | | 800° C. | 850° C. | 900° C. | 950° C. | 1000° C. | 1050° C. | 800° C. | 850° C. | 900° C. | 950° C. | 1000° C. | 1050° C. |
| Comparative Example | 1 | 10.3 (197) | 34.0 (336) | 33.2 (329) | 34.0 (336) | 34.1 (337) | 34.2 (338) | 92.2 | 91.2 | 88.3 | 74.5 | 67.3 | 59.8 |
| | 2 | 25.1 (267) | 45.3 (450) | 46.0 (459) | 46.3 (463) | 46.1 (460) | 45.6 (454) | 59.1 | 43.2 | 20.6 | 14.9 | 11.8 | 7.2 |
| | 3 | 6.1 (180) | 28.5 (290) | 43.0 (423) | 45.1 (448) | 50.6 (521) | 51.2 (527) | 34.6 | 19.6 | 14.9 | 12.7 | 7.0 | 3.4 |
| | 4 | 5.6 (179) | 32.3 (321) | 46.2 (464) | 52.3 (541) | 56.7 (611) | 37.8 (371) | 25.5 | 16.7 | 15.5 | 10.8 | 6.9 | 2.9 |
| | 5 | 8.1 (188) | 28.6 (291) | 34.9 (345) | 43.1 (424) | 54.5 (580) | 34.6 (342) | 80.6 | 56.8 | 14.5 | 6.9 | 7.1 | 6.5 |
| Example | A01 | 17.5 (228) | 36.0 (355) | 35.9 (354) | 36.8 (362) | 37.8 (371) | 37.5 (368) | 95.8 | 94.1 | 91.2 | 75.2 | 67.7 | 56.9 |
| | A02 | 8.2 (189) | 35.2 (347) | 35.1 (346) | 35.2 (347) | 35.0 (346) | 34.9 (345) | 95.1 | 91.2 | 88.0 | 76.5 | 66.2 | 54.9 |
| | A03 | 12.5 (206) | 35.0 (346) | 34.9 (345) | 34.1 (337) | 36.0 (355) | 35.2 (347) | 92.2 | 88.3 | 85.3 | 69.6 | 60.8 | 51.0 |
| | A11 | 11.6 (203) | 35.3 (348) | 35.4 (349) | 34.0 (336) | 35.8 (353) | 34.8 (344) | 91.2 | 92.2 | 89.3 | 75.5 | 68.3 | 60.7 |

TABLE 5-continued

| Quenching Temperature | | Rockwell Hardness HRC (Vickers Hardness Hv) | | | | | | Absorbed Energy at Room Temperature (J/cm$^2$) | | | | | |
|---|---|---|---|---|---|---|---|---|---|---|---|---|---|
| No. | | 800° C. | 850° C. | 900° C. | 950° C. | 1000° C. | 1050° C. | 800° C. | 850° C. | 900° C. | 950° C. | 1000° C. | 1050° C. |
| | A12 | 12.1 (205) | 34.9 (345) | 34.8 (344) | 37.9 (372) | 36.3 (357) | 34.7 (343) | 94.2 | 93.2 | 90.3 | 76.5 | 69.3 | 61.8 |
| | A13 | 12.4 (206) | 35.1 (346) | 35.1 (346) | 34.3 (339) | 35.8 (353) | 34.9 (345) | 93.9 | 93.6 | 90.1 | 77.1 | 70.1 | 62.2 |

TABLE 6

| Quenching Temperature | | Rockwell Hardness HRC (Vickers Hardness Hv) | | | | | | Absorbed Energy at Room Temperature (J/cm$^2$) | | | | | |
|---|---|---|---|---|---|---|---|---|---|---|---|---|---|
| No. | | 800° C. | 850° C. | 900° C. | 950° C. | 1000° C. | 1050° C. | 800° C. | 850° C. | 900° C. | 950° C. | 1000° C. | 1050° C. |
| Example | A21 | 8.4 (190) | 35.5 (350) | 35.2 (347) | 35.3 (348) | 34.9 (345) | 34.8 (344) | 94.1 | 92.9 | 90.1 | 76.3 | 69.1 | 61.5 |
| | A22 | 17.0 (226) | 36.1 (356) | 35.9 (354) | 36.7 (361) | 37.7 (370) | 37.5 (368) | 91.1 | 94.9 | 92.1 | 78.3 | 70.1 | 63.5 |
| | A23 | 7.7 (187) | 33.2 (329) | 34.3 (339) | 34.6 (342) | 34.6 (342) | 36.7 (361) | 92.1 | 91.3 | 88.2 | 75.1 | 67.1 | 59.6 |
| | A31 | 11.1 (200) | 35.7 (352) | 36.0 (355) | 35.9 (354) | 35.4 (349) | 36.8 (362) | 94.2 | 92.8 | 90.2 | 76.2 | 69.2 | 61.4 |
| | A32 | 10.9 (200) | 35.5 (350) | 35.9 (354) | 36.0 (355) | 35.7 (352) | 36.1 (356) | 92.0 | 91.3 | 88.1 | 75.1 | 67.0 | 59.5 |
| | A33 | 16.0 (221) | 37.7 (370) | 37.4 (367) | 37.1 (365) | 37.1 (365) | 37.6 (369) | 91.2 | 94.9 | 92.0 | 78.2 | 70.6 | 63.6 |
| | A41 | 8.9 (192) | 35.8 (353) | 35.3 (348) | 35.1 (346) | 35.1 (346) | 34.6 (342) | 93.1 | 92.6 | 90.1 | 76.1 | 69.3 | 60.4 |
| | A42 | 11.9 (204) | 35.2 (347) | 35.4 (349) | 34.1 (337) | 35.3 (348) | 35.0 (346) | 93.9 | 93.1 | 90.4 | 76.8 | 69.5 | 61.7 |
| | A51 | 12.1 (205) | 35.6 (351) | 35.4 (349) | 34.9 (345) | 35.7 (343) | 34.8 (344) | 93.8 | 93.2 | 89.9 | 76.8 | 69.5 | 61.8 |
| | A52 | 8.1 (188) | 33.4 (331) | 34.5 (341) | 34.4 (340) | 34.5 (341) | 36.6 (360) | 92.8 | 91.5 | 88.5 | 75.5 | 67.3 | 59.3 |
| | A61 | 11.4 (202) | 35.6 (351) | 35.6 (351) | 34.1 (337) | 35.5 (350) | 34.6 (342) | 91.3 | 92.4 | 89.6 | 75.4 | 68.4 | 60.8 |
| | A62 | 9.0 (192) | 33.4 (328) | 34.1 (337) | 34.5 (341) | 34.5 (341) | 36.9 (363) | 92.3 | 91.5 | 88.4 | 75.3 | 67.4 | 59.2 |

TABLE 7

| Quenching Temperature | | Rockwell Hardness HRC (Vickers Hardness Hv) | | | | | | Absorbed Energy at Room Temperature (J/cm$^2$) | | | | | |
|---|---|---|---|---|---|---|---|---|---|---|---|---|---|
| No. | | 800° C. | 850° C. | 900° C. | 950° C. | 1000° C. | 1050° C. | 800° C. | 850° C. | 900° C. | 950° C. | 1000° C. | 1050° C. |
| Example | B01 | 9.8 (195) | 33.7 (333) | 35.2 (347) | 34.5 (341) | 34.9 (345) | 36.6 (360) | 91.2 | 89.2 | 87.3 | 74.4 | 64.7 | 53.0 |
| | B02 | 16.1 (222) | 36.2 (356) | 36.4 (358) | 36.2 (356) | 37.3 (366) | 37.1 (365) | 97.1 | 90.2 | 88.3 | 75.5 | 61.8 | 59.8 |
| | B03 | 12.2 (205) | 35.5 (350) | 36.0 (355) | 35.7 (352) | 36.0 (355) | 35.9 (354) | 92.2 | 88.3 | 86.3 | 70.6 | 60.8 | 53.0 |
| | B11 | 12.1 (205) | 35.8 (353) | 35.0 (346) | 35.8 (353) | 35.9 (354) | 36.0 (355) | 91.8 | 89.3 | 87.4 | 74.5 | 64.7 | 53.1 |
| | B21 | 12.3 (205) | 36.1 (356) | 35.2 (347) | 35.8 (353) | 36.1 (356) | 35.9 (354) | 91.9 | 89.2 | 86.9 | 74.0 | 63.2 | 51.9 |
| | B31 | 12.0 (204) | 34.5 (341) | 33.4 (331) | 34.3 (339) | 34.1 (337) | 34.4 (340) | 91.3 | 89.1 | 87.1 | 73.6 | 64.5 | 54.0 |
| | B41 | 11.9 (204) | 34.6 (342) | 33.5 (332) | 34.5 (341) | 34.4 (340) | 34.6 (342) | 93.4 | 92.9 | 90.4 | 76.2 | 69.1 | 61.5 |
| | B51 | 11.8 (203) | 34.8 (344) | 35.6 (351) | 35.5 (350) | 35.9 (354) | 35.9 (354) | 94.1 | 93.1 | 90.3 | 76.3 | 69.3 | 61.8 |
| | B61 | 11.6 (203) | 35.0 (346) | 35.8 (353) | 35.6 (351) | 35.9 (354) | 35.8 (353) | 93.2 | 92.2 | 89.3 | 75.5 | 68.3 | 60.7 |
| | C01 | 18.2 (231) | 38.3 (376) | 38.5 (377) | 36.8 (378) | 38.4 (376) | 38.0 (373) | 95.2 | 93.2 | 91.2 | 76.5 | 67.1 | 61.6 |
| | C02 | 11.0 (200) | 35.5 (350) | 36.1 (356) | 36.0 (355) | 35.4 (349) | 36.4 (358) | 94.0 | 91.0 | 89.1 | 78.2 | 67.7 | 60.8 |

TABLE 7-continued

| Quenching Temperature | | Rockwell Hardness HRC (Vickers Hardness Hv) | | | | | | Absorbed Energy at Room Temperature (J/cm$^2$) | | | | | |
|---|---|---|---|---|---|---|---|---|---|---|---|---|---|
| No. | | 800° C. | 850° C. | 900° C. | 950° C. | 1000° C. | 1050° C. | 800° C. | 850° C. | 900° C. | 950° C. | 1000° C. | 1050° C. |
| | C03 | 22.0 (249) | 38.7 (379) | 38.4 (376) | 38.1 (374) | 38.0 (373) | 38.7 (379) | 94.2 | 91.2 | 89.3 | 78.5 | 67.6 | 60.6 |

TABLE 8

| Quenching Temperature | | Rockwell Hardness HRC (Vickers Hardness Hv) | | | | | | Absorbed Energy at Room Temperature (J/cm$^2$) | | | | | |
|---|---|---|---|---|---|---|---|---|---|---|---|---|---|
| No. | | 800° C. | 850° C. | 900° C. | 950° C. | 1000° C. | 1050° C. | 800° C. | 850° C. | 900° C. | 950° C. | 1000° C. | 1050° C. |
| Example | C11 | 10.5 (198) | 35.0 (346) | 34.2 (338) | 35.0 (346) | 35.1 (346) | 35.2 (347) | 95.0 | 91.8 | 90.1 | 78.9 | 67.4 | 60.7 |
| | C21 | 10.6 (198) | 34.8 (344) | 34.9 (345) | 34.8 (344) | 34.9 (345) | 35.0 (346) | 94.5 | 91.6 | 89.6 | 78.6 | 67.8 | 60.9 |
| | C31 | 10.1 (196) | 34.0 (336) | 33.2 (329) | 34.1 (337) | 34.2 (338) | 34.1 (337) | 94.7 | 91.8 | 89.8 | 78.6 | 68.1 | 61.5 |
| | C41 | 12.5 (206) | 35.2 (347) | 35.3 (348) | 34.2 (338) | 35.7 (352) | 34.8 (344) | 93.9 | 93.7 | 90.2 | 77.2 | 70.2 | 62.4 |
| | C51 | 12.2 (205) | 35.0 (346) | 34.8 (344) | 34.3 (339) | 35.9 (354) | 35.1 (346) | 94.6 | 93.3 | 90.2 | 76.5 | 69.5 | 61.3 |
| | C61 | 11.4 (202) | 35.6 (351) | 36.0 (355) | 36.0 (355) | 35.3 (348) | 37.0 (364) | 92.8 | 93.9 | 91.9 | 78.2 | 70.7 | 63.7 |
| | D01 | 7.5 (186) | 35.1 (346) | 36.4 (358) | 35.0 (346) | 35.4 (349) | 36.2 (356) | 93.0 | 100.0 | 89.1 | 76.7 | 66.0 | 56.1 |
| | D02 | 7.6 (188) | 33.3 (330) | 34.2 (338) | 34.7 (343) | 34.6 (342) | 36.8 (362) | 101.1 | 95.0 | 93.3 | 80.8 | 68.3 | 59.9 |
| | D03 | 19.0 (234) | 38.7 (379) | 38.4 (376) | 38.1 (374) | 38.0 (373) | 38.6 (378) | 94.2 | 91.2 | 89.3 | 78.5 | 67.7 | 60.3 |
| | D11 | 10.8 (199) | 34.5 (341) | 33.7 (333) | 34.5 (341) | 34.6 (342) | 34.7 (343) | 93.2 | 100.3 | 89.2 | 76.9 | 66.3 | 56.2 |
| | D21 | 10.7 (198) | 34.4 (340) | 33.9 (336) | 34.4 (340) | 34.5 (341) | 34.7 (343) | 92.8 | 99.7 | 89.0 | 76.5 | 65.7 | 56.0 |
| | D31 | 10.6 (198) | 34.3 (339) | 33.1 (328) | 34.3 (339) | 34.0 (336) | 34.3 (339) | 93.4 | 100.1 | 89.6 | 77.1 | 66.1 | 56.6 |

TABLE 9

| Quenching Temperature | | Rockwell Hardness HRC (Vickers Hardness Hv) | | | | | | Absorbed Energy at Room Temperature (J/cm$^2$) | | | | | |
|---|---|---|---|---|---|---|---|---|---|---|---|---|---|
| No. | | 800° C. | 850° C. | 900° C. | 950° C. | 1000° C. | 1050° C. | 800° C. | 850° C. | 900° C. | 950° C. | 1000° C. | 1050° C. |
| Example | D41 | 16.4 (223) | 36.1 (356) | 35.7 (352) | 36.9 (363) | 37.2 (366) | 37.5 (368) | 96.8 | 94.1 | 91.2 | 75.2 | 67.7 | 56.9 |
| | D51 | 13.2 (209) | 35.3 (348) | 34.9 (345) | 34.4 (340) | 35.8 (353) | 35.9 (354) | 95.2 | 94.2 | 90.3 | 76.5 | 69.3 | 61.8 |
| | D61 | 10.7 (199) | 34.2 (338) | 33.7 (334) | 34.1 (337) | 34.1 (337) | 34.2 (338) | 94.6 | 94.1 | 89.8 | 76.6 | 68.7 | 60.7 |
| | E01 | 8.7 (191) | 35.2 (347) | 35.2 (347) | 35.6 (351) | 35.3 (348) | 35.5 (350) | 94.3 | 93.8 | 89.5 | 76.3 | 68.2 | 60.5 |
| | E11 | 10.6 (198) | 35.6 (351) | 35.9 (354) | 36.1 (356) | 35.6 (351) | 36.4 (358) | 92.5 | 84.8 | 92.2 | 78.4 | 70.1 | 63.5 |
| | F01 | 10.9 (200) | 35.6 (351) | 35.9 (354) | 35.8 (353) | 35.3 (348) | 36.6 (360) | 91.2 | 87.9 | 85.3 | 69.6 | 60.8 | 51.0 |
| | F11 | 10.5 (198) | 35.5 (350) | 35.8 (353) | 36.0 (355) | 35.7 (352) | 36.1 (356) | 92.4 | 88.5 | 85.4 | 70.0 | 60.9 | 53.2 |
| | G01 | 11.9 (209) | 34.8 (344) | 34.8 (344) | 38.9 (381) | 36.7 (361) | 35.7 (352) | 93.8 | 93.7 | 90.1 | 77.1 | 68.6 | 62.4 |
| | H01 | 11.5 (202) | 35.1 (346) | 34.8 (344) | 36.2 (356) | 36.3 (357) | 34.7 (343) | 92.7 | 88.4 | 85.5 | 70.4 | 61.5 | 54.4 |
| | J01 | 10.7 (199) | 34.8 (344) | 34.6 (342) | 39.7 (389) | 36.8 (362) | 34.3 (339) | 93.9 | 93.5 | 90.2 | 77.3 | 70.2 | 62.3 |
| | K01 | 11.2 (201) | 34.9 (345) | 35.1 (346) | 35.9 (354) | 36.3 (357) | 35.0 (346) | 94.3 | 93.3 | 90.4 | 76.6 | 69.4 | 61.9 |
| | L01 | 11.3 (201) | 35.0 (346) | 34.9 (345) | 35.9 (354) | 35.6 (351) | 35.2 (347) | 94.6 | 93.6 | 91.0 | 76.5 | 70.3 | 62.2 |

TABLE 9-continued

| Quenching Temperature | | Rockwell Hardness HRC (Vickers Hardness Hv) | | | | | | Absorbed Energy at Room Temperature (J/cm$^2$) | | | | | |
|---|---|---|---|---|---|---|---|---|---|---|---|---|---|
| No. | | 800° C. | 850° C. | 900° C. | 950° C. | 1000° C. | 1050° C. | 800° C. | 850° C. | 900° C. | 950° C. | 1000° C. | 1050° C. |
| | L02 | 10.6 (198) | 34.8 (344) | 34.8 (344) | 37.9 (372) | 36.5 (359) | 35.7 (352) | 93.9 | 93.2 | 90.7 | 75.9 | 69.6 | 62.5 |

TABLE 10

| | | Sag Length Z (mm) | | Base Material Bending Test | | Integrated Drilling Length (mm) Cutting Rate 0.35 | Cutting Rate 0.20 | Oxidation Weight Increas (g/m$^2$) | |
|---|---|---|---|---|---|---|---|---|---|
| | No. | ϕ150 | ϕ50 | 180° | 90° | (m/sec) | (m/sec) | 850° C. | 1000° C. |
| Comparative Example | 1 | 0.84 | 0.29 | B B B | A A B | 208 | 622 | 8.67 | 13.71 |
| | 2 | 0.79 | 0.28 | C C C | C C C | 178 | 584 | 9.98 | 14.32 |
| | 3 | 0.58 | 0.19 | C C C | C C C | 221 | 639 | 10.34 | 14.63 |
| | 4 | 0.73 | 0.23 | C C C | C C C | 214 | 633 | 11.65 | 14.97 |
| | 5 | 0.59 | 0.20 | C C C | C C C | 187 | 617 | 11.48 | 15.01 |
| Example | A01 | 0.71 | 0.24 | B B B | A A A | 209 | 638 | 8.31 | 13.07 |
| | A02 | 0.43 | 0.16 | B B B | A A B | 212 | 647 | 8.80 | 13.13 |
| | A03 | 0.11 | 0.06 | B B B | A A A | 234 | 711 | 9.12 | 13.98 |
| | A11 | 0.70 | 0.24 | B B B | A A A | 197 | 683 | 9.02 | 13.65 |
| | A12 | 0.34 | 0.14 | B B B | A A B | 168 | 629 | 8.50 | 13.74 |
| | A13 | 0.21 | 0.10 | B B B | A A A | 178 | 665 | 7.91 | 13.63 |
| | A21 | 0.51 | 0.18 | B B B | A A B | 188 | 694 | 8.14 | 13.34 |
| | A22 | 0.39 | 0.14 | B B B | A A A | 145 | 596 | 8.23 | 13.24 |
| | A23 | 0.13 | 0.07 | B B B | A A A | 215 | 646 | 8.89 | 13.56 |
| | A31 | 0.65 | 0.23 | B B B | A A A | 207 | 644 | 8.91 | 13.43 |
| | A32 | 0.39 | 0.13 | B B B | A A A | 187 | 638 | 8.96 | 13.27 |
| | A33 | 0.23 | 0.09 | B B B | A A B | 189 | 642 | 8.81 | 13.22 |
| | A41 | 0.27 | 0.10 | B B B | A A B | 203 | 651 | 8.48 | 13.28 |
| | A42 | 0.40 | 0.16 | B B B | A A A | 218 | 676 | 8.38 | 13.21 |
| | A51 | 0.21 | 0.09 | B B B | A A A | 206 | 659 | 8.30 | 13.76 |
| | A52 | 0.28 | 0.10 | B B B | A A A | 228 | 681 | 8.65 | 13.59 |
| | A61 | 0.17 | 0.06 | B B B | A A A | 214 | 657 | 8.77 | 13.68 |
| | A62 | 0.25 | 0.09 | B B B | A A A | 184 | 632 | 8.45 | 13.43 |
| | B01 | 0.61 | 0.25 | B B B | A A A | 193 | 640 | 9.23 | 14.21 |
| | B02 | 0.51 | 0.18 | B B B | A A A | 177 | 634 | 8.47 | 13.43 |
| | B03 | 0.18 | 0.07 | B B B | A A B | 203 | 658 | 8.06 | 12.89 |
| | B11 | 0.37 | 0.13 | B B B | A A A | 222 | 679 | 8.34 | 13.21 |
| | B21 | 0.17 | 0.08 | B B B | A A A | 215 | 663 | 8.22 | 13.12 |
| | B31 | 0.31 | 0.11 | B B B | A A A | 177 | 594 | 8.58 | 13.45 |
| | B41 | 0.19 | 0.09 | B B B | A A A | 187 | 611 | 8.91 | 13.93 |
| | B51 | 0.29 | 0.11 | B B B | A A A | 186 | 689 | 8.28 | 13.67 |
| | B61 | 0.23 | 0.08 | B B B | A A A | 190 | 657 | 8.15 | 13.11 |
| | C01 | 0.16 | 0.07 | A A B | A A A | 206 | 669 | 9.08 | 13.85 |
| | C02 | 0.52 | 0.19 | A A A | A A A | 209 | 664 | 8.78 | 13.76 |
| | C03 | 0.56 | 0.19 | A A A | A A A | 215 | 688 | 8.88 | 13.79 |

TABLE 11

| | | Sag Length Z (mm) | | Base Material Bending Test | | IntegRated Drilling Length (mm) Cutting Rate 0.35 | Cutting Rate 0.20 | Oxidation Weight Increase (g/m$^2$) | |
|---|---|---|---|---|---|---|---|---|---|
| | No. | ϕ150 | ϕ50 | 180° | 90° | (m/sec) | (m/sec) | 850° C. | 1000° C. |
| Example | C11 | 0.17 | 0.07 | A A A | A A A | 236 | 712 | 8.80 | 13.74 |
| | C21 | 0.21 | 0.07 | A A A | A A A | 214 | 672 | 8.78 | 13.81 |
| | C31 | 0.28 | 0.09 | A A A | A A A | 221 | 678 | 8.64 | 13.79 |

TABLE 11-continued

| No. | Sag Length Z (mm) φ150 | Sag Length Z (mm) φ50 | Base Material Bending Test 180° | Base Material Bending Test 90° | IntegRated Drilling Length (mm) Cutting Rate 0.35 (m/sec) | IntegRated Drilling Length (mm) Cutting Rate 0.20 (m/sec) | Oxidation Weight Increase ($g/m^2$) 850° C. | Oxidation Weight Increase ($g/m^2$) 1000° C. |
|---|---|---|---|---|---|---|---|---|
| C41 | 0.29 | 0.11 | A A A | A A A | 170 | 631 | 9.01 | 13.67 |
| C51 | 0.25 | 0.09 | A A A | A A A | 193 | 576 | 7.84 | 13.04 |
| C61 | 0.26 | 0.09 | A A A | A A A | 210 | 599 | 9.12 | 13.69 |
| D01 | 0.51 | 0.18 | A A A | A A A | 216 | 632 | 8.54 | 13.48 |
| D02 | 0.56 | 0.19 | A A A | A A A | 209 | 645 | 8.41 | 13.14 |
| D03 | 0.22 | 0.07 | A B B | A A A | 205 | 655 | 8.35 | 13.39 |
| D11 | 0.57 | 0.21 | A A A | A A A | 201 | 649 | 8.23 | 13.31 |
| D21 | 0.56 | 0.19 | A A A | A A A | 205 | 646 | 8.44 | 13.40 |
| D31 | 0.15 | 0.06 | A A A | A A A | 187 | 618 | 8.42 | 13.43 |
| D41 | 0.31 | 0.13 | A A A | A A A | 179 | 606 | 8.14 | 13.24 |
| D51 | 0.25 | 0.09 | A A A | A A A | 201 | 590 | 8.19 | 13.04 |
| D61 | 0.19 | 0.07 | A A A | A A A | 196 | 622 | 8.87 | 13.12 |
| E01 | 0.38 | 0.15 | B B B | A A A | 193 | 604 | 4.02 | 6.71 |
| E11 | 0.32 | 0.12 | B B B | A A B | 221 | 677 | 4.32 | 6.78 |
| F01 | 0.35 | 0.13 | B B B | A A A | 341 | 11109 | 8.51 | 13.46 |
| F11 | 0.26 | 0.10 | B B B | A A A | 321 | 11056 | 8.34 | 13.49 |
| G01 | 0.23 | 0.09 | B B B | A A A | 199 | 614 | 5.01 | 6.21 |
| H01 | 0.25 | 0.09 | B B B | A A A | 349 | 11164 | 8.47 | 13.14 |
| J01 | 0.22 | 0.08 | A A A | A A A | 187 | 650 | 4.65 | 6.52 |
| K01 | 0.13 | 0.08 | A A A | A A A | 344 | 11096 | 8.34 | 13.37 |
| L01 | 0.64 | 0.20 | A A B | A A A | 335 | 11049 | 4.43 | 6.53 |
| L02 | 0.30 | 0.11 | A A A | A A A | 361 | 11181 | 4.02 | 5.97 |

TABLE 12

| Quenching Temperature | | Salt Spray Test (35° C. Å 4 hr) | | | | | | Salt Spray Test (35° C. Å 12 hr) | | | | | |
|---|---|---|---|---|---|---|---|---|---|---|---|---|---|
| No. | | 800° C. | 850° C. | 900° C. | 950° C. | 1000° C. | 1050° C. | 800° C. | 850° C. | 900° C. | 950° C. | 1000° C. | 1050° C. |
| Comparative Example | 1 | A | A | A | A | A | A | B | B | B | B | B | B |
| | 2 | A | A | A | A | A | A | C | C | C | C | C | C |
| | 3 | C | C | A | A | A | A | C | C | C | C | C | C |
| | 4 | C | C | A | A | A | A | C | C | C | C | C | C |
| | 5 | C | C | A | A | A | A | C | C | C | C | C | C |
| Example | A01 | A | A | A | A | A | A | B | B | B | B | B | B |
| | A02 | A | A | A | A | A | A | B | B | B | B | B | B |
| | A03 | A | A | A | A | A | A | B | B | B | B | B | B |
| | A11 | A | A | A | A | A | A | B | B | B | B | B | B |
| | A12 | A | A | A | A | A | A | B | B | B | B | B | B |
| | A13 | A | A | A | A | A | A | B | B | B | B | B | B |
| | A21 | A | A | A | A | A | A | B | B | B | B | B | B |
| | A22 | A | A | A | A | A | A | B | B | B | B | B | B |
| | A23 | A | A | A | A | A | A | B | B | B | B | B | B |
| | A31 | A | A | A | A | A | A | B | B | B | B | B | B |
| | A32 | A | A | A | A | A | A | B | B | B | B | B | B |
| | A33 | A | A | A | A | A | A | B | B | B | B | B | B |
| | A41 | A | A | A | A | A | A | B | B | B | B | B | B |
| | A42 | A | A | A | A | A | A | B | B | B | B | B | B |
| | A51 | A | A | A | A | A | A | B | B | B | B | B | B |
| | A52 | A | A | A | A | A | A | B | B | B | B | B | B |
| | A61 | A | A | A | A | A | A | B | B | B | B | B | B |
| | A62 | A | A | A | A | A | A | B | B | B | B | B | B |
| | B01 | A | A | A | A | A | A | B | B | A | A | A | A |
| | B02 | A | A | A | A | A | A | A | A | A | A | A | A |
| | B03 | A | A | A | A | A | A | A | A | A | A | A | A |
| | B11 | A | A | A | A | A | A | A | A | A | A | A | A |
| | B21 | A | A | A | A | A | A | A | A | A | A | A | A |
| | B31 | A | A | A | A | A | A | B | B | A | A | A | A |
| | B41 | A | A | A | A | A | A | B | B | A | A | A | A |
| | B51 | A | A | A | A | A | A | A | A | A | A | A | A |
| | B61 | A | A | A | A | A | A | A | A | A | A | A | A |
| | C01 | A | A | A | A | A | A | B | B | B | B | B | B |
| | C02 | A | A | A | A | A | A | B | B | B | B | B | B |
| | C03 | A | A | A | A | A | A | B | B | B | B | B | B |

TABLE 13

| Quenching Temperature | | Salt Spray Test (35° C. Å 4 hr) | | | | | | Salt Spray Test (35° C. Å 12 hr) | | | | | |
|---|---|---|---|---|---|---|---|---|---|---|---|---|---|
| No. | | 800° C. | 850° C. | 900° C. | 950° C. | 1000° C. | 1050° C. | 800° C. | 850° C. | 900° C. | 950° C. | 1000° C. | 1050° C. |
| Example | C11 | A | A | A | A | A | A | B | B | B | B | B | B |
| | C21 | A | A | A | A | A | A | B | B | B | B | B | B |
| | C31 | A | A | A | A | A | A | B | B | B | B | B | B |
| | C41 | A | A | A | A | A | A | B | B | B | B | B | B |
| | C51 | A | A | A | A | A | A | B | B | B | B | B | B |
| | C61 | A | A | A | A | A | A | B | B | B | B | B | B |
| | D01 | A | A | A | A | A | A | A | A | A | A | A | A |
| | D02 | A | A | A | A | A | A | A | A | A | A | A | A |
| | D03 | A | A | A | A | A | A | A | A | A | A | A | A |
| | D11 | A | A | A | A | A | A | A | A | A | A | A | A |
| | D21 | A | A | A | A | A | A | A | A | A | A | A | A |
| | D31 | A | A | A | A | A | A | A | A | A | A | A | A |
| | D41 | A | A | A | A | A | A | A | A | A | A | A | A |
| | D51 | A | A | A | A | A | A | A | A | A | A | A | A |
| | D61 | A | A | A | A | A | A | B | A | A | A | A | A |
| | E01 | A | A | A | A | A | A | B | B | B | B | B | B |
| | E11 | A | A | A | A | A | A | B | B | B | B | B | B |
| | F01 | A | A | A | A | A | A | B | B | B | B | B | B |
| | F11 | A | A | A | A | A | A | B | B | B | B | B | B |
| | G01 | A | A | A | A | A | A | B | B | A | A | A | A |
| | H01 | A | A | A | A | A | A | A | A | A | A | A | A |
| | J01 | A | A | A | A | A | A | B | B | B | B | B | B |
| | K01 | A | A | A | A | A | A | B | B | B | B | B | B |
| | L01 | A | A | A | A | A | A | B | B | A | A | A | A |
| | L02 | A | A | A | A | A | A | B | A | A | A | A | A |

TABLE 14

| Steel | Chemical Component (mass %) | | | | | | | | | |
|---|---|---|---|---|---|---|---|---|---|---|
| No. | C | Si | Mn | Ni | Cu | Nb | Cr | N | Others | Remarks |
| A | 0.061 | 0.28 | 1.55 | 0.08 | 0.51 | 0.31 | 12.31 | 0.014 | Ca = 0.0190 | |
| B | 0.059 | 0.29 | 1.56 | 0.07 | 0.01 | 0.29 | 12.30 | 0.014 | Co = 0.26 | |
| C | 0.092 | 0.32 | 1.54 | 0.08 | 0.01 | 0.32 | 12.32 | 0.014 | V = 0.15 | |
| D | 0.062 | 0.31 | 1.56 | 0.07 | 0.01 | 0.01 | 12.33 | 0.014 | Hf = 0.15, Ca = 0.0300 | |
| E | 0.025 | 0.33 | 1.85 | 0.15 | 0.11 | 0.50 | 12.41 | 0.020 | Mg = 0.0490, Co = 0.18 | |
| F | 0.043 | 0.55 | 2.55 | 0.22 | 0.15 | 0.30 | 12.54 | 0.026 | Mo = 0.380, V = 0.09 | |
| G | 0.065 | 0.75 | 1.30 | 0.47 | 0.25 | 0.22 | 11.47 | 0.016 | Zr = 0.06 | |
| H | 0.064 | 0.75 | 1.83 | 0.77 | 0.63 | 0.75 | 14.15 | 0.011 | Ta = 0.12, Ca = 0.0340 | |
| I | 0.057 | 0.23 | 1.42 | 0.33 | 0.21 | 0.09 | 10.38 | 0.020 | B = 0.0022, Hf = 0.01 | |
| J | 0.054 | 0.29 | 1.56 | 0.47 | 0.33 | 0.18 | 12.14 | 0.145 | Ti = 0.15, Co = 0.34 | |
| K | 0.055 | 0.41 | 1.67 | 0.28 | 0.15 | 0.22 | 12.40 | 0.183 | W = 0.31, B = 0.0011 | |

TABLE 15

| | | Annealing Condition | | | | Hardness | Sag Characteristic | | | |
|---|---|---|---|---|---|---|---|---|---|---|
| No. | Steel | Heating Rate (° C./min) | Annealing Temperature (° C.) | Soaking Time (Hr) | Cooling Rate (° C./min) | After Annealing (HRB) | Sag X (mm) | Sag Z (mm) | Remarks | |
| 1 | A | 35 | 645 | 3 | 23 | 103 | 1.5 | 0.16 | Comparative Example | The die life is two thirds of No. 2. |
| 2 | A | 21 | 650 | 8 | 27 | 93 | 1.8 | 0.18 | Example | |
| 3 | B | 45 | 715 | 6 | 14 | 91 | 1.9 | 0.18 | Example | |
| 4 | B | 37 | 775 | 6 | 15 | 79 | 4.2 | 0.38 | Comparative Example | |
| 5 | C | 28 | 720 | 9 | 23 | 93 | 1.7 | 0.16 | Example | |
| 6 | C | 70 | 725 | 9 | 25 | 83 | 3.7 | 0.34 | Comparative Example | |
| 7 | D | 34 | 705 | 8 | 27 | 91 | 1.8 | 0.12 | Example | |
| 8 | D | 61 | 710 | 8 | 25 | 84 | 3.6 | 0.35 | Comparative Example | |
| 9 | E | 27 | 605 | 10 | 18 | 95 | 1.8 | 0.18 | Example | |
| 10 | E | 38 | 610 | 15 | 17 | 82 | 3.7 | 0.37 | Comparative Example | |
| 11 | F | 41 | 715 | 11 | 23 | 92 | 1.7 | 0.17 | Example | |

TABLE 15-continued

| No. | Steel | Annealing Condition: Heating Rate (° C./min) | Annealing Temperature (° C.) | Soaking Time (Hr) | Cooling Rate (° C./min) | Hardness After Annealing (HRB) | Sag Characteristic: Sag X (mm) | Sag Z (mm) | Remarks |
|---|---|---|---|---|---|---|---|---|---|
| 12 | F | 28 | 710 | 14 | 27 | 83 | 3.6 | 0.34 | Comparative Example |
| 13 | G | 30 | 480 | 5 | 18 | 109 | 1.3 | 0.13 | Comparative Example The die life is two thirds of No. 14. |
| 14 | G | 35 | 645 | 5 | 17 | 96 | 1.5 | 0.14 | Example |
| 15 | H | 31 | 505 | 8 | 21 | 105 | 1.2 | 0.13 | Comparative Example The die life is two thirds of No. 16. |
| 16 | H | 44 | 615 | 8 | 22 | 98 | 1.4 | 0.15 | Example |
| 17 | I | 29 | 700 | 3 | 18 | 102 | 1.7 | 0.15 | Comparative Example The die life is two thirds of No. 18. |
| 18 | I | 25 | 695 | 5 | 19 | 93 | 1.8 | 0.16 | Example |
| 19 | J | 35 | 560 | 7 | 25 | 99 | 1.5 | 0.15 | Example |
| 20 | K | 48 | 735 | 9 | 16 | 91 | 1.7 | 0.17 | Example |

What is claimed is:

1. A low carbon martensitic stainless steel sheet having heat resistance, comprising, on the basis of mass percent:

0.030% to 0.100% C;

0.50% or less of Si;

1.00% to 2.50% Mn;

more than 10.00% to 15.00% Cr;

at least one selected from the group consisting of:

0.01% to 0.50% Ti;

0.01% to 0.50% V;

0.01% to 1.00% Nb; and 0.01% to 1.00% Zr;

N in an amount defined by the following expression:

N: 0.005% to (Ti+V)×14/50+(Nb+Zr)×14/90; and the balance being Fe and incidental impurities.

2. The martensitic stainless steel sheet having heat resistance and excellent workability according to claim 1, further comprising, on the basis of mass percent:

more than 0.040% to 0.100% C+N; and 0.02% to 0.50% in total of at least one selected from the group consisting of:

0.01% to 0.50% V;

0.01% to 0.50% Nb;

0.01% to 0.50% Ti;

0.01% to 0.50% Zr;

0.50% or less of Ta; and 0.50% or less of Hf.

3. The low carbon martensitic stainless steel sheet having heat resistance and excellent workability according to claim 1, further comprising, on the basis of mass percent, at least one selected from the group consisting of:

0.01% to 1.00% Ni and 0.01% to 0.50% Cu.

4. The low carbon martensitic stainless steel sheet having heat resistance and excellent workability according to claim 1, further comprising, on the basis of mass percent, at least one selected from the group consisting of:

0.050% to 1.000% Mo and 0.0002% to 0.0010% B.

5. The low carbon martensitic stainless steel sheet having heat resistance and excellent workability according to claim 1, further comprising, on the basis of mass percent, 0.01% to 1.00% Nb, 0.050% to 1.000% Mo, and 0.0002% to 0.0010% B.

6. The martensitic stainless steel sheet having heat resistance and excellent workability according to claim 1, further comprising, on the basis of mass percent, at least one selected from the group consisting of:

0.01% to 0.50% Co and 0.01% to 0.50% W.

7. The martensitic stainless steel sheet having heat resistance and excellent workability according to claim 1, further comprising, on the basis of mass percent, at least one selected from the group consisting of:

0.0002% to 0.0050% Ca and 0.0002% to 0.0050% Mg.

8. The low carbon martensitic stainless steel sheet having heat resistance and excellent workability according to claim 3, further comprising 0.60% by mass or less of Ni.

9. The martensitic stainless steel sheet having heat resistance and excellent workability according to claim 1, further comprising 0.100% by mass or less of Al.

10. A manufacturing method of the low carbon martensitic stainless steel sheet having heat resistance and excellent workability according to claim 1, wherein said steel is subjected to hot rolling and then annealing at a temperature of 550° C. to 750° C.

11. The manufacturing method of the low carbon martensitic stainless steel sheet having heat resistance and excellent workability according to claim 10, wherein the annealing step comprises heating at a heating rate of 20° C./min. to 50° C./min. followed by cooling from the annealing temperature to 500° C. at a cooling rate of 5° C./min. to 30° C./min.

12. The manufacturing method of the low carbon martensitic stainless steel sheet having heat resistance and excellent workability according to claim 10, wherein the annealing time in the annealing step is 4 hours to 12 hours.

13. The manufacturing method of the low carbon martensitic stainless steel sheet having heat resistance and excellent workability according to claim 10, wherein the sheet after the annealing step and before punching has an HRB hardness of 85 to 100.

14. The low carbon martensitic stainless steel sheet having heat resistance and excellent workability according to claim 2, further comprising, on the basis of mass percent, at least one selected from the group consisting of:

0.01% to 1.00% Ni and 0.01% to 0.50% Cu.

15. The low carbon martensitic stainless steel sheet having heat resistance and excellent workability according to claim 2, further comprising, on the basis of mass percent, 0.01% to 1.00% Nb, 0.050% to 1.000% Mo, and 0.0002% to 0.0010% B.

16. The manufacturing method of the low carbon martensitic stainless steel sheet having heat resistance and excellent workability according to claim 11, wherein the annealing time in the annealing step is 4 hours to 12 hours.

17. The manufacturing method of the low carbon martensitic stainless steel sheet having heat resistance and excellent workability according to claim 11, wherein the sheet after the annealing step and before punching has an HRB hardness of 85 to 100.

18. The manufacturing method of the low carbon martensitic stainless steel sheet having heat resistance and excellent workability according to claim 12, wherein the sheet after the annealing step and before punching has an HRB hardness of 85 to 100.

* * * * *